US012239872B2

(12) United States Patent
Smith

(10) Patent No.: US 12,239,872 B2
(45) Date of Patent: Mar. 4, 2025

(54) SAFETY MECHANISM FOR AN ADJUSTABLE DUMBBELL

(71) Applicant: iFIT Inc., Logan, UT (US)

(72) Inventor: Kent M. Smith, Nibley, UT (US)

(73) Assignee: iFIT Inc., Logan, UT (US)

( * ) Notice: Subject to any disclaimer, the term of this patent is extended or adjusted under 35 U.S.C. 154(b) by 0 days.

(21) Appl. No.: 18/537,480

(22) Filed: Dec. 12, 2023

(65) Prior Publication Data

US 2024/0108938 A1 Apr. 4, 2024

Related U.S. Application Data

(63) Continuation of application No. 17/672,459, filed on Feb. 15, 2022, now Pat. No. 11,878,199.

(60) Provisional application No. 63/150,066, filed on Feb. 16, 2021.

(51) Int. Cl.

| | |
|---|---|
| ***A63B 21/075*** | (2006.01) |
| ***A63B 24/00*** | (2006.01) |
| ***A63B 71/00*** | (2006.01) |

(52) U.S. Cl.

CPC ..... *A63B 21/075* (2013.01); *A63B 24/0087* (2013.01); *A63B 71/0054* (2013.01); *A63B 2220/13* (2013.01)

(58) Field of Classification Search

CPC . A63B 21/072; A63B 21/075; A63B 24/0087; A63B 71/0054; A63B 2220/13

See application file for complete search history.

(56) References Cited

U.S. PATENT DOCUMENTS

| | | | |
|---|---|---|---|
| 3,123,646 | A | 3/1964 | Easton |
| 3,579,339 | A | 5/1971 | Chang et al. |
| 4,023,795 | A | 5/1977 | Pauls |
| 4,300,760 | A | 11/1981 | Bobroff |
| D286,311 | S | 10/1986 | Martinell et al. |
| 4,681,318 | A | 7/1987 | Lay |
| 4,684,126 | A | 8/1987 | Dalebout et al. |
| 4,728,102 | A | 3/1988 | Pauls |
| 4,750,736 | A | 6/1988 | Watterson |
| 4,796,881 | A | 1/1989 | Watterson |

(Continued)

FOREIGN PATENT DOCUMENTS

| | | | |
|---|---|---|---|
| CN | 102233169 | A | 11/2011 |
| CN | 105457213 | A | 4/2016 |

(Continued)

OTHER PUBLICATIONS

English Machine Translation (provided by EPO) of the description of CN 107773909 A. (Year: 2018).*

(Continued)

*Primary Examiner* — Joshua Lee

(74) *Attorney, Agent, or Firm* — Holland & Hart LLP

(57) ABSTRACT

An adjustable kettlebell includes a cradle safety mechanism and a kettlebell safety mechanism. The cradle safety mechanism includes a position sensor that detects whether the kettlebell is in the cradled position and prevents a motor from rotating to change the weight of the kettlebell if the kettlebell is in the uncradled position. The kettlebell safety mechanism includes a dial retractable into the handle of the kettlebell. When the dial is retracted into the kettlebell, a selection mechanism cannot be rotated to change a weight of the kettlebell.

19 Claims, 7 Drawing Sheets

(56) References Cited

U.S. PATENT DOCUMENTS 4,813,667 A 3/1989 Watterson
4,830,371 A 5/1989 Lay
4,844,451 A 7/1989 Bersonnet et al.
4,850,585 A 7/1989 Dalebout et al.
D304,849 S 11/1989 Watterson
4,880,225 A 11/1989 Lucas et al.
4,883,272 A 11/1989 Lay
D306,468 S 3/1990 Watterson
D306,891 S 3/1990 Watterson
4,913,396 A 4/1990 Dalebout et al.
D307,614 S 5/1990 Bingham et al.
D307,615 S 5/1990 Bingham et al.
4,921,242 A 5/1990 Watterson
4,932,650 A 6/1990 Bingham et al.
D309,167 S 7/1990 Griffin
D309,485 S 7/1990 Bingham et al.
4,938,478 A 7/1990 Lay
D310,253 S 8/1990 Bersonnet et al.
4,955,599 A 9/1990 Bersonnet et al.
4,971,316 A 11/1990 Dalebout et al.
D313,055 S 12/1990 Watterson
4,974,832 A 12/1990 Dalebout
4,979,737 A 12/1990 Kock
4,981,294 A 1/1991 Dalebout et al.
D315,765 S 3/1991 Measom et al.
4,998,725 A 3/1991 Watterson et al.
5,000,442 A 3/1991 Dalebout et al.
5,000,443 A 3/1991 Dalebout et al.
5,000,444 A 3/1991 Dalebout et al.
D316,124 S 4/1991 Dalebout et al.
5,013,033 A 5/1991 Watterson et al.
5,014,980 A 5/1991 Bersonnet et al.
5,016,871 A 5/1991 Dalebout et al.
D318,085 S 7/1991 Jacobson et al.
D318,086 S 7/1991 Bingham et al.
D318,699 S 7/1991 Jacobson et al.
5,029,801 A 7/1991 Dalebout et al.
5,034,576 A 7/1991 Dalebout et al.
5,058,881 A 10/1991 Measom
5,058,882 A 10/1991 Dalebout et al.
D321,388 S 11/1991 Dalebout
5,062,626 A 11/1991 Dalebout et al.
5,062,627 A 11/1991 Bingham
5,062,632 A 11/1991 Dalebout et al.
5,062,633 A 11/1991 Engel et al.
5,067,710 A 11/1991 Watterson et al.
5,072,929 A 12/1991 Peterson et al.
D323,009 S 1/1992 Dalebout et al.
D323,198 S 1/1992 Dalebout et al.
D323,199 S 1/1992 Dalebout et al.
D323,863 S 2/1992 Watterson
5,088,729 A 2/1992 Dalebout
5,090,694 A 2/1992 Pauls et al.
5,102,380 A 4/1992 Jacobson et al.
5,104,120 A 4/1992 Watterson et al.
5,108,093 A 4/1992 Watterson
D326,491 S 5/1992 Dalebout
5,122,105 A 6/1992 Engel et al.
5,135,216 A 8/1992 Bingham et al.
5,147,265 A 9/1992 Pauls et al.
5,149,084 A 9/1992 Dalebout et al.
5,149,312 A 9/1992 Croft et al.
5,171,196 A 12/1992 Lynch
D332,347 S 1/1993 Raadt et al.
5,190,505 A 3/1993 Dalebout et al.
5,192,255 A 3/1993 Dalebout et al.
5,195,937 A 3/1993 Engel et al.
5,203,826 A 4/1993 Dalebout
D335,511 S 5/1993 Engel et al.
D335,905 S 5/1993 Cutter et al.
D336,498 S 6/1993 Engel et al.
5,217,487 A 6/1993 Engel et al.
D337,361 S 7/1993 Engel et al.
D337,666 S 7/1993 Peterson et al.
D337,799 S 7/1993 Cutter et al.
5,226,866 A 7/1993 Engel et al.
5,244,446 A 9/1993 Engel et al.
5,247,853 A 9/1993 Dalebout
5,259,611 A 11/1993 Dalebout et al.
D342,106 S 12/1993 Campbell et al.
5,279,528 A 1/1994 Dalebout et al.
D344,112 S 2/1994 Smith
D344,557 S 2/1994 Ashby
5,282,776 A 2/1994 Dalebout
5,295,931 A 3/1994 Dreibelbis et al.
5,302,161 A 4/1994 Loubert et al.
D347,251 S 5/1994 Dreibelbis et al.
5,316,534 A 5/1994 Dalebout et al.
D348,493 S 7/1994 Ashby
D348,494 S 7/1994 Ashby
5,328,164 A 7/1994 Soga
D349,931 S 8/1994 Bostic et al.
5,336,142 A 8/1994 Dalebout et al.
5,344,376 A 9/1994 Bostic et al.
D351,202 S 10/1994 Bingham
D351,435 S 10/1994 Peterson et al.
D351,633 S 10/1994 Bingham
D352,534 S 11/1994 Dreibelbis et al.
D353,422 S 12/1994 Bostic et al.
5,372,559 A 12/1994 Dalebout et al.
5,374,228 A 12/1994 Buisman et al.
5,382,221 A 1/1995 Hsu et al.
5,387,168 A 2/1995 Bostic
5,393,690 A 2/1995 Fu et al.
D356,128 S 3/1995 Smith et al.
5,409,435 A 4/1995 Daniels
5,429,563 A 7/1995 Engel et al.
5,431,612 A 7/1995 Holden
D360,915 S 8/1995 Bostic et al.
5,468,205 A 11/1995 McFall et al.
5,489,249 A 2/1996 Brewer et al.
5,492,517 A 2/1996 Bostic et al.
D367,689 S 3/1996 Wilkinson et al.
5,511,740 A 4/1996 Loubert et al.
5,512,025 A 4/1996 Dalebout et al.
D370,949 S 6/1996 Furner
D371,176 S 6/1996 Furner
5,527,245 A 6/1996 Dalebout et al.
5,529,553 A 6/1996 Finlayson
5,540,429 A 7/1996 Dalebout et al.
5,549,533 A 8/1996 Olson et al.
5,554,085 A 9/1996 Dalebout
5,569,128 A 10/1996 Dalebout
5,591,105 A 1/1997 Dalebout et al.
5,591,106 A 1/1997 Dalebout et al.
5,595,556 A 1/1997 Dalebout et al.
5,607,375 A 3/1997 Dalebout et al.
5,611,539 A 3/1997 Watterson et al.
5,622,527 A 4/1997 Watterson et al.
5,626,538 A 5/1997 Dalebout et al.
5,626,542 A 5/1997 Dalebout et al.
D380,024 S 6/1997 Novak et al.
5,637,059 A 6/1997 Dalebout
D380,509 S 7/1997 Wilkinson et al.
5,643,153 A 7/1997 Nylen et al.
5,645,509 A 7/1997 Brewer et al.
D384,118 S 9/1997 Deblauw
5,662,557 A 9/1997 Watterson et al.
5,669,857 A 9/1997 Watterson et al.
5,672,140 A 9/1997 Watterson et al.
5,674,156 A 10/1997 Watterson et al.
5,674,453 A 10/1997 Watterson et al.
5,676,624 A 10/1997 Watterson et al.
5,683,331 A 11/1997 Dalebout
5,683,332 A 11/1997 Watterson et al.
D387,825 S 12/1997 Fleck et al.
5,695,433 A 12/1997 Buisman
5,695,434 A 12/1997 Dalebout et al.
5,695,435 A 12/1997 Dalebout et al.
5,702,325 A 12/1997 Watterson et al.
5,704,879 A 1/1998 Watterson et al.
5,718,657 A 2/1998 Dalebout et al.
5,720,200 A 2/1998 Anderson et al.
5,720,698 A 2/1998 Dalebout et al.

(56) References Cited

U.S. PATENT DOCUMENTS

D392,006 S 3/1998 Dalebout et al.
5,722,922 A 3/1998 Watterson et al.
5,733,229 A 3/1998 Dalebout et al.
5,743,833 A 4/1998 Watterson et al.
5,762,584 A 6/1998 Daniels
5,762,587 A 6/1998 Dalebout et al.
5,772,560 A 6/1998 Watterson et al.
5,810,698 A 9/1998 Hullett et al.
5,827,155 A 10/1998 Jensen et al.
5,830,114 A 11/1998 Halfen et al.
5,860,893 A 1/1999 Watterson et al.
5,860,894 A 1/1999 Dalebout et al.
5,899,834 A 5/1999 Dalebout et al.
D412,953 S 8/1999 Armstrong
D413,948 S 9/1999 Dalebout
5,951,441 A 9/1999 Dalebout et al.
5,951,448 A 9/1999 Bolland
D416,596 S 11/1999 Armstrong
6,003,166 A 12/1999 Hald et al.
6,019,710 A 2/2000 Dalebout et al.
6,027,429 A 2/2000 Daniels
6,033,347 A 3/2000 Dalebout et al.
D425,940 S 5/2000 Halfen et al.
6,059,692 A 5/2000 Hickman
D428,949 S 8/2000 Simonson
6,123,646 A 9/2000 Colassi
6,171,217 B1 1/2001 Cutler
6,171,219 B1 1/2001 Simonson
6,174,267 B1 1/2001 Dalebout et al.
6,193,631 B1 2/2001 Hickman
6,228,003 B1 5/2001 Hald et al.
6,238,323 B1 5/2001 Simonson
6,251,052 B1 6/2001 Simonson
6,261,022 B1 7/2001 Dalebout et al.
6,280,362 B1 8/2001 Dalebout et al.
6,296,594 B1 10/2001 Simonson
D450,872 S 11/2001 Dalebout et al.
6,312,363 B1 11/2001 Watterson et al.
D452,338 S 12/2001 Dalebout et al.
D453,543 S 2/2002 Cutler
D453,948 S 2/2002 Cutler
6,350,218 B1 2/2002 Dalebout et al.
6,387,020 B1 5/2002 Simonson
6,413,191 B1 7/2002 Harris et al.
6,422,980 B1 7/2002 Simonson
6,447,424 B1 9/2002 Ashby et al.
6,458,060 B1 10/2002 Watterson et al.
6,458,061 B2 10/2002 Simonson
6,471,622 B1 10/2002 Hammer et al.
6,563,225 B2 5/2003 Soga et al.
6,601,016 B1 7/2003 Brown et al.
6,623,140 B2 9/2003 Watterson et al.
6,626,799 B2 9/2003 Watterson et al.
6,652,424 B2 11/2003 Dalebout
6,685,607 B1 2/2004 Olson
6,695,581 B2 2/2004 Wasson et al.
6,701,271 B2 3/2004 Willner et al.
6,702,719 B1 3/2004 Brown et al.
6,712,740 B2 3/2004 Simonson
6,730,002 B2 5/2004 Hald et al.
6,743,153 B2 6/2004 Watterson et al.
6,746,371 B1 6/2004 Brown et al.
6,749,537 B1 6/2004 Hickman
6,761,667 B1 7/2004 Cutler et al.
6,770,015 B2 8/2004 Simonson
6,786,852 B2 9/2004 Watterson et al.
6,808,472 B1 10/2004 Hickman
6,821,230 B2 11/2004 Dalebout et al.
6,830,540 B2 12/2004 Watterson et al.
6,863,641 B1 3/2005 Brown et al.
6,866,613 B1 3/2005 Brown et al.
6,875,160 B2 4/2005 Watterson et al.
D507,311 S 7/2005 Butler et al.
6,918,858 B2 7/2005 Watterson et al.
6,921,351 B1 7/2005 Hickman et al.
6,974,404 B1 12/2005 Watterson et al.
6,997,852 B2 2/2006 Watterson et al.
7,025,713 B2 4/2006 Dalebout et al.
D520,085 S 5/2006 Willardson et al.
7,044,897 B2 5/2006 Myers et al.
7,052,442 B2 5/2006 Watterson et al.
7,060,006 B1 6/2006 Watterson et al.
7,060,008 B2 6/2006 Watterson et al.
7,070,539 B2 7/2006 Brown et al.
7,097,588 B2 8/2006 Watterson et al.
D527,776 S 9/2006 Willardson et al.
7,112,168 B2 9/2006 Dalebout et al.
7,128,693 B2 10/2006 Brown et al.
7,166,062 B1 1/2007 Watterson et al.
7,166,064 B2 1/2007 Watterson et al.
7,169,087 B2 1/2007 Ercanbrack et al.
7,169,093 B2 1/2007 Simonson et al.
7,192,388 B2 3/2007 Dalebout et al.
7,250,022 B2 7/2007 Dalebout et al.
7,282,016 B2 10/2007 Simonson
7,285,075 B2 10/2007 Cutler et al.
7,344,481 B2 3/2008 Watterson et al.
7,377,882 B2 5/2008 Watterson et al.
7,425,188 B2 9/2008 Ercanbrack et al.
7,429,236 B2 9/2008 Dalebout et al.
7,455,622 B2 11/2008 Watterson et al.
7,482,050 B2 1/2009 Olson
D588,655 S 3/2009 Utykanski
7,510,509 B2 3/2009 Hickman
7,537,546 B2 5/2009 Watterson et al.
7,537,549 B2 5/2009 Nelson et al.
7,537,552 B2 5/2009 Dalebout et al.
7,540,828 B2 6/2009 Watterson et al.
7,549,947 B2 6/2009 Hickman et al.
7,556,590 B2 7/2009 Watterson et al.
7,563,203 B2 7/2009 Dalebout et al.
7,575,536 B1 8/2009 Hickman
7,601,105 B1 10/2009 Gipson et al.
7,604,573 B2 10/2009 Dalebout et al.
D604,373 S 11/2009 Dalebout et al.
7,618,350 B2 11/2009 Dalebout et al.
7,618,357 B2 11/2009 Dalebout et al.
7,625,315 B2 12/2009 Hickman
7,625,321 B2 12/2009 Simonson et al.
7,628,730 B1 12/2009 Watterson et al.
7,628,737 B2 12/2009 Kowallis et al.
7,637,847 B1 12/2009 Hickman
7,645,212 B2 1/2010 Ashby et al.
7,645,213 B2 1/2010 Watterson et al.
7,658,698 B2 2/2010 Pacheco et al.
7,674,205 B2 3/2010 Dalebout et al.
7,713,171 B1 5/2010 Hickman
7,713,172 B2 5/2010 Watterson et al.
7,713,180 B2 5/2010 Wickens et al.
7,717,828 B2 5/2010 Simonson et al.
7,736,279 B2 6/2010 Dalebout et al.
7,740,563 B2 6/2010 Dalebout et al.
7,749,144 B2 7/2010 Hammer
7,766,797 B2 8/2010 Dalebout et al.
7,771,329 B2 8/2010 Dalebout et al.
7,775,940 B2 8/2010 Dalebout et al.
7,789,800 B1 9/2010 Watterson et al.
7,798,946 B2 9/2010 Dalebout et al.
7,815,550 B2 10/2010 Watterson et al.
7,857,731 B2 12/2010 Hickman et al.
7,862,475 B2 1/2011 Watterson et al.
7,862,478 B2 1/2011 Watterson et al.
7,862,483 B2 1/2011 Hendrickson et al.
D635,207 S 3/2011 Dalebout et al.
7,901,330 B2 3/2011 Dalebout et al.
7,909,740 B2 3/2011 Dalebout et al.
7,976,443 B2 * 7/2011 Krull ..... A63B 21/0728 482/107
7,980,996 B2 7/2011 Hickman
7,981,000 B2 7/2011 Watterson et al.
7,981,013 B2 * 7/2011 Krull ..... A63B 21/0728 482/107
7,985,164 B2 7/2011 Ashby
8,029,415 B2 10/2011 Ashby et al.

(56) References Cited

U.S. PATENT DOCUMENTS 8,033,960 B1 10/2011 Dalebout et al.
D650,451 S 12/2011 Olson et al.
D652,877 S 1/2012 Dalebout et al.
8,152,702 B2 4/2012 Pacheco
D659,775 S 5/2012 Olson et al.
D659,777 S 5/2012 Watterson et al.
D660,383 S 5/2012 Watterson et al.
D664,613 S 7/2012 Dalebout et al.
8,251,874 B2 8/2012 Ashby et al.
8,298,123 B2 10/2012 Hickman
8,298,125 B2 10/2012 Colledge et al.
D671,177 S 11/2012 Sip
D671,178 S 11/2012 Sip
D673,626 S 1/2013 Olson et al.
8,690,735 B2 4/2014 Watterson et al.
D707,763 S 6/2014 Cutler
8,740,753 B2 6/2014 Olson et al.
8,758,201 B2 6/2014 Ashby et al.
8,771,153 B2 7/2014 Dalebout et al.
8,784,270 B2 7/2014 Ashby et al.
8,784,280 B2 * 7/2014 Krull ..... A63B 21/00065 482/106
8,808,148 B2 8/2014 Watterson et al.
8,814,762 B2 8/2014 Butler et al.
D712,493 S 9/2014 Ercanbrack et al.
8,840,075 B2 9/2014 Dalebout et al.
8,845,493 B2 9/2014 Watterson et al.
8,870,726 B2 10/2014 Watterson et al.
8,876,668 B2 11/2014 Hendrickson et al.
8,894,549 B2 11/2014 Colledge
8,894,555 B2 11/2014 Colledge et al.
8,911,330 B2 12/2014 Watterson et al.
8,920,288 B2 12/2014 Dalebout et al.
8,986,165 B2 3/2015 Ashby
8,992,364 B2 3/2015 Law et al.
8,992,387 B2 3/2015 Watterson et al.
D726,476 S 4/2015 Ercanbrack
9,028,368 B2 5/2015 Ashby et al.
9,028,370 B2 5/2015 Watterson et al.
9,039,578 B2 5/2015 Dalebout
D731,011 S 6/2015 Buchanan
9,072,930 B2 7/2015 Ashby et al.
9,119,983 B2 9/2015 Rhea
9,123,317 B2 9/2015 Watterson et al.
9,126,071 B2 9/2015 Smith
9,126,072 B2 9/2015 Watterson
9,138,615 B2 9/2015 Olson et al.
9,142,139 B2 9/2015 Watterson et al.
9,144,703 B2 9/2015 Dalebout et al.
9,149,683 B2 10/2015 Watterson et al.
9,186,535 B2 11/2015 Ercanbrack
9,186,549 B2 11/2015 Watterson et al.
9,254,409 B2 2/2016 Dalebout et al.
9,254,416 B2 2/2016 Ashby
9,278,248 B2 3/2016 Tyger et al.
9,278,249 B2 3/2016 Watterson
9,278,250 B2 3/2016 Buchanan
9,289,648 B2 3/2016 Watterson
9,339,691 B2 5/2016 Brammer
9,352,185 B2 5/2016 Hendrickson et al.
9,352,186 B2 5/2016 Watterson
9,375,605 B2 6/2016 Tyger et al.
9,381,394 B2 7/2016 Mortensen et al.
9,387,387 B2 7/2016 Dalebout
9,393,453 B2 7/2016 Watterson
9,403,047 B2 8/2016 Olson et al.
9,403,051 B2 8/2016 Cutler
9,421,416 B2 8/2016 Mortensen et al.
9,457,219 B2 10/2016 Smith
9,457,220 B2 10/2016 Olson
9,457,222 B2 10/2016 Dalebout
9,460,632 B2 10/2016 Watterson
9,463,356 B2 10/2016 Rhea
9,468,794 B2 10/2016 Barton
9,468,798 B2 10/2016 Dalebout
9,480,874 B2 11/2016 Cutler
9,492,704 B2 11/2016 Mortensen et al.
9,498,668 B2 11/2016 Smith
9,517,378 B2 12/2016 Ashby et al.
9,521,901 B2 12/2016 Dalebout
9,533,187 B2 1/2017 Dalebout
9,539,461 B2 1/2017 Ercanbrack
9,579,544 B2 2/2017 Watterson
9,586,086 B2 3/2017 Dalebout et al.
9,586,090 B2 3/2017 Watterson et al.
9,604,099 B2 3/2017 Taylor
9,616,276 B2 4/2017 Dalebout et al.
9,616,278 B2 4/2017 Olson
9,623,281 B2 4/2017 Hendrickson et al.
9,636,567 B2 5/2017 Brammer et al.
9,675,839 B2 6/2017 Dalebout et al.
9,682,307 B2 6/2017 Dalebout
9,694,234 B2 7/2017 Dalebout et al.
9,694,242 B2 7/2017 Ashby et al.
9,737,755 B2 8/2017 Dalebout
9,757,605 B2 9/2017 Olson et al.
9,764,186 B2 9/2017 Dalebout et al.
9,767,785 B2 9/2017 Ashby et al.
9,795,822 B2 10/2017 Smith et al.
9,808,672 B2 11/2017 Dalebout
9,844,695 B1 * 12/2017 Shorter ..... A63B 21/075
9,849,326 B2 12/2017 Smith
9,878,210 B2 1/2018 Watterson
9,889,334 B2 2/2018 Ashby et al.
9,889,339 B2 2/2018 Douglass
9,937,376 B2 4/2018 McInelly et al.
9,937,377 B2 4/2018 McInelly et al.
9,937,378 B2 4/2018 Dalebout et al.
9,937,379 B2 4/2018 Mortensen et al.
9,943,719 B2 4/2018 Smith et al.
9,943,722 B2 4/2018 Dalebout
9,948,037 B2 4/2018 Ashby
9,968,816 B2 5/2018 Olson et al.
9,968,821 B2 5/2018 Finlayson et al.
9,968,823 B2 5/2018 Cutler
10,010,755 B2 7/2018 Watterson
10,010,756 B2 7/2018 Watterson
10,029,145 B2 7/2018 Douglass
D826,350 S 8/2018 Hochstrasser
10,046,196 B2 8/2018 Ercanbrack et al.
D827,733 S 9/2018 Hochstrasser
10,065,064 B2 9/2018 Smith et al.
10,071,285 B2 9/2018 Smith et al.
10,085,586 B2 10/2018 Smith et al.
10,086,254 B2 10/2018 Watterson
10,099,083 B1 * 10/2018 Owusu ..... A63B 24/0062
10,136,842 B2 11/2018 Ashby
10,186,161 B2 1/2019 Watterson
10,188,890 B2 1/2019 Olson et al.
10,207,143 B2 2/2019 Dalebout et al.
10,207,145 B2 2/2019 Tyger et al.
10,207,147 B2 2/2019 Ercanbrack et al.
10,207,148 B2 2/2019 Powell et al.
10,212,994 B2 2/2019 Watterson et al.
10,220,259 B2 3/2019 Brammer
10,226,396 B2 3/2019 Ashby
10,226,664 B2 3/2019 Dalebout et al.
10,252,109 B2 4/2019 Watterson
10,258,828 B2 4/2019 Dalebout et al.
10,272,317 B2 4/2019 Watterson
10,279,212 B2 5/2019 Dalebout et al.
10,293,211 B2 5/2019 Watterson et al.
D852,292 S 6/2019 Cutler
10,343,017 B2 7/2019 Jackson
10,376,736 B2 8/2019 Powell et al.
10,388,183 B2 8/2019 Watterson
10,391,361 B2 8/2019 Watterson
10,420,978 B2 * 9/2019 Wang ..... A63B 21/072
D864,320 S 10/2019 Weston
D864,321 S 10/2019 Weston
10,426,989 B2 10/2019 Dalebout
10,433,612 B2 10/2019 Ashby et al.
10,441,840 B2 10/2019 Dalebout
10,441,844 B2 10/2019 Powell

(56) References Cited

U.S. PATENT DOCUMENTS 10,449,416 B2 10/2019 Dalebout et al.
10,463,906 B2 * 11/2019 Owusu ..... A63B 21/072
10,471,299 B2 11/2019 Powell
D868,909 S 12/2019 Cutler et al.
10,492,519 B2 12/2019 Capell et al.
10,493,349 B2 12/2019 Watterson
10,500,473 B2 12/2019 Watterson
10,537,764 B2 1/2020 Smith et al.
10,543,395 B2 1/2020 Powell et al.
10,561,877 B2 2/2020 Workman
10,561,893 B2 2/2020 Chatterton et al.
10,561,894 B2 2/2020 Dalebout et al.
10,569,121 B2 2/2020 Watterson
10,569,123 B2 2/2020 Hochstrasser et al.
10,625,114 B2 4/2020 Ercanbrack
10,625,137 B2 4/2020 Dalebout et al.
10,661,114 B2 5/2020 Watterson et al.
10,668,320 B2 6/2020 Watterson
10,671,705 B2 6/2020 Capell et al.
10,688,346 B2 6/2020 Brammer
10,695,614 B2 * 6/2020 Owusu ..... A61B 5/6895
10,702,736 B2 7/2020 Weston et al.
10,709,925 B2 7/2020 Dalebout et al.
10,726,730 B2 7/2020 Watterson
10,729,965 B2 8/2020 Powell
10,758,767 B2 9/2020 Olson et al.
10,786,700 B2 * 9/2020 Owusu ..... A63B 21/075

10,786,706 B2 9/2020 Smith
10,864,407 B2 12/2020 Watterson et al.
10,918,905 B2 2/2021 Powell et al.
10,932,517 B2 3/2021 Ashby et al.
10,940,360 B2 3/2021 Dalebout et al.
10,953,268 B1 3/2021 Dalebout et al.
10,953,305 B2 3/2021 Dalebout et al.
10,967,214 B1 4/2021 Olson et al.
10,994,173 B2 5/2021 Watterson
11,000,730 B2 5/2021 Dalebout et al.
11,013,960 B2 5/2021 Watterson et al.
11,033,777 B1 6/2021 Watterson et al.
11,058,913 B2 7/2021 Dalebout et al.
11,058,914 B2 7/2021 Powell
11,058,918 B1 7/2021 Watterson et al.
11,185,731 B2 * 11/2021 Wang ..... A63B 21/075
11,187,285 B2 11/2021 Wrobel
RE49,009 E * 4/2022 Wang ..... A63B 21/072

11,298,577 B2 4/2022 Watterson
11,326,673 B2 5/2022 Buchanan
11,338,169 B2 5/2022 Dalebout et al.
11,338,175 B2 5/2022 Watterson et al.
11,426,633 B2 8/2022 Watterson et al.
11,451,108 B2 9/2022 Tinney
11,452,903 B2 9/2022 Watterson
11,491,361 B2 * 11/2022 Flick ..... A63B 21/075
11,511,152 B2 11/2022 Powell et al.
11,534,651 B2 12/2022 Ercanbrack et al.
11,534,654 B2 12/2022 Silcock et al.
11,534,655 B2 12/2022 Dalebout et al.
11,565,148 B2 1/2023 Dalebout et al.
11,596,830 B2 3/2023 Dalebout et al.
11,642,564 B2 5/2023 Watterson
11,673,036 B2 6/2023 Dalebout et al.
11,680,611 B2 6/2023 Wrobel
11,700,905 B2 7/2023 Ashby et al.
11,708,874 B2 7/2023 Wrobel
11,779,812 B2 10/2023 Watterson
11,794,052 B2 10/2023 Olson et al.
11,794,070 B2 10/2023 Hays et al.
11,794,075 B2 10/2023 Watterson et al.
2008/0051256 A1 2/2008 Ashby et al.
2010/0120589 A1 * 5/2010 Krull ..... A63B 21/075
482/93
2010/0210427 A1 * 8/2010 Yu ..... A63B 21/072
482/93
2011/0263392 A1 * 10/2011 Yu ..... A63B 21/075
482/93

2015/0251055 A1 9/2015 Ashby
2016/0058335 A1 3/2016 Ashby
2016/0089560 A1 3/2016 Smith et al.
2016/0121074 A1 5/2016 Ashby
2016/0346595 A1 12/2016 Dalebout et al.
2017/0124912 A1 5/2017 Ashby et al.
2017/0193578 A1 7/2017 Watterson
2017/0259106 A1 9/2017 Pawlas et al.
2017/0266489 A1 9/2017 Douglass et al.
2017/0270820 A1 9/2017 Ashby et al.
2018/0085630 A1 3/2018 Capell et al.
2018/0099116 A1 4/2018 Ashby
2018/0099180 A1 4/2018 Wilkinson
2018/0111034 A1 4/2018 Watterson
2019/0223612 A1 7/2019 Watterson et al.
2019/0240526 A1 * 8/2019 Owusu ..... A63B 21/00065

2019/0269971 A1 9/2019 Capell et al.
2020/0009417 A1 1/2020 Dalebout
2020/0078632 A1 * 3/2020 Owusu ..... A63B 21/4035
2020/0114204 A1 * 4/2020 Owusu ..... A63B 24/0087

2021/0001177 A1 1/2021 Smith
2021/0046353 A1 2/2021 Dalebout et al.
2021/0106899 A1 4/2021 Willardson et al.
2021/0110910 A1 4/2021 Ostler et al.
2021/0146221 A1 5/2021 Dalebout et al.
2021/0291013 A1 9/2021 Nascimento
2021/0299518 A1 9/2021 Brammer et al.
2021/0299542 A1 9/2021 Brammer et al.
2021/0339079 A1 11/2021 Dalebout et al.
2022/0062685 A1 3/2022 Ashby et al.
2022/0104992 A1 4/2022 Ashby
2022/0212052 A1 7/2022 Ercanbrack et al.
2022/0241649 A1 8/2022 Ashby
2022/0241665 A1 8/2022 Dalebout et al.
2022/0241668 A1 8/2022 Willardson et al.
2022/0249912 A1 8/2022 Watterson et al.
2022/0257994 A1 8/2022 Smith
2022/0258007 A1 8/2022 Watterson et al.
2022/0258008 A1 8/2022 Watterson et al.
2022/0266085 A1 8/2022 Dalebout et al.
2022/0280857 A1 9/2022 Watterson
2022/0309042 A1 9/2022 Archer
2022/0314078 A1 10/2022 Watterson et al.
2022/0323827 A1 10/2022 Watterson et al.
2022/0339493 A1 10/2022 Larsen
2022/0339520 A1 10/2022 Toth
2022/0342969 A1 10/2022 Watterson et al.
2022/0347516 A1 11/2022 Taylor
2022/0347548 A1 11/2022 Watterson
2022/0362613 A1 11/2022 Watterson et al.
2022/0362624 A1 11/2022 Dalebout
2022/0395729 A1 12/2022 Toth
2023/0039903 A1 2/2023 Brammer et al.
2023/0054845 A1 2/2023 Smith
2023/0122235 A1 4/2023 Ashby et al.
2023/0128721 A1 4/2023 Plummer
2023/0158358 A1 5/2023 Ercanbrack et al.
2023/0181993 A1 6/2023 Taylor et al.
2023/0191189 A1 6/2023 Taylor et al.
2023/0191197 A1 6/2023 Ashby
2023/0218975 A1 7/2023 Toles et al.
2023/0226401 A1 7/2023 Watterson
2023/0271056 A1 8/2023 Cutler et al.
2023/0277892 A1 9/2023 Smith et al.
2023/0285799 A1 9/2023 Dalebout et al.
2023/0304548 A1 9/2023 Wrobel
2023/0321482 A1 10/2023 Vasquez et al.

(56) References Cited

U.S. PATENT DOCUMENTS

| | | | |
|---|---|---|---|
| 2023/0330476 | A1 | 10/2023 | Ashby et al. |
| 2023/0360248 | A1 | 11/2023 | Ashby et al. |

FOREIGN PATENT DOCUMENTS

| | | | |
|---|---|---|---|
| CN | 107773908 | A | 3/2018 |
| CN | 107773909 | A | 3/2018 |
| CN | 112368054 | A | 2/2021 |

OTHER PUBLICATIONS

Second Office Action in Chinese Patent Application No. 202210143311.8, mailed Jan. 31, 2024, 7 pages.
U.S. Appl. No. 17/066,485, filed Oct. 9, 2020, Weston et al.
U.S. Appl. No. 17/739,819, filed May 9, 2022, Buchanan.
U.S. Appl. No. 17/841,313, filed Jun. 15, 2022, Weston et al.
U.S. Appl. No. 17/963,822, filed Oct. 11, 2022, Powell.
U.S. Appl. No. 18/091,004, filed Dec. 29, 2022, Cox.
U.S. Appl. No. 18/123,026, filed Mar. 17, 2023, Silcock et al.
U.S. Appl. No. 18/207,512, filed Jun. 8, 2023, Chuang.
U.S. Appl. No. 18/210,505, filed Jun. 15, 2023, Nielsen et al.
U.S. Appl. No. 18/242,840, filed Sep. 6, 2023, Brammer et al.
U.S. Appl. No. 18/482,491, filed Oct. 6, 2023, Willardson et al.
U.S. Appl. No. 29/702,127, filed Sep. 16, 2019, Cutler et al.
U.S. Appl. No. 62/273,852, filed Dec. 31, 2015, Watterson.
U.S. Appl. No. 63/073,081, filed Sep. 1, 2021, Ashby et al.
U.S. Appl. No. 63/079,697, filed Sep. 7, 2020, Willardson et al.
U.S. Appl. No. 63/086,793, filed Oct. 20, 2020, Ashby.
U.S. Appl. No. 63/134,036, filed Jan. 5, 2021, Ercanbrack et al.
U.S. Appl. No. 63/150,066, filed Feb. 16, 2021, Smith.
U.S. Appl. No. 63/156,801, filed Mar. 4, 2021, Watterson.
U.S. Appl. No. 63/165,498, filed Mar. 24, 2021, Archer.
U.S. Appl. No. 63/179,094, filed Apr. 23, 2021, Watterson et al.
U.S. Appl. No. 63/180,521, filed Apr. 27, 2021, Watterson et al.
U.S. Appl. No. 63/187,348, filed May 11, 2021, Dalebout et al.
U.S. Appl. No. 63/188,431, filed May 13, 2021, Plummer.
U.S. Appl. No. 63/200,903, filed Apr. 2, 2021, Watterson et al.
U.S. Appl. No. 63/211,870, filed Jun. 17, 2021, Watterson et al.
U.S. Appl. No. 63/216,313, filed Jun. 29, 2021, Watterson et al.
U.S. Appl. No. 63/229,794, filed Aug. 12, 2021, Brammer.
U.S. Appl. No. 63/235,002, filed Aug. 19, 2021, Smith.
U.S. Appl. No. 63/254,470, filed Oct. 11, 2021, Powell.
U.S. Appl. No. 63/278,714, filed Nov. 12, 2021, Taylor.
U.S. Appl. No. 63/289,997, filed Dec. 15, 2021, Taylor et al.
U.S. Appl. No. 63/290,455, filed Dec. 16, 2021, Taylor et al.
U.S. Appl. No. 63/290,557, filed Dec. 16, 2021, Ashby.
U.S. Appl. No. 63/298,170, filed Jan. 10, 2022, Ercanbrack et al.
U.S. Appl. No. 63/299,357, filed Jan. 13, 2022, Toles et al.
U.S. Appl. No. 63/305,976, filed Feb. 2, 2022, Watterson.
U.S. Appl. No. 329,270, filed Apr. 8, 2022, Vasquez et al.
U.S. Appl. No. 63/332,581, filed Apr. 25, 2022, Ashby et al.
U.S. Appl. No. 63/338,265, filed May 4, 2022, Ashby et al.
U.S. Appl. No. 63/350,072, filed Jun. 8, 2022, Chuang.
U.S. Appl. No. 63/352,539, filed Jun. 15, 2022, Nielsen et al.
U.S. Appl. No. 63/471,680, filed Jun. 7, 2023, Powell et al.
Taiwan Office Action with English translation issued in application 111105588 on Nov. 8, 2022, 15 pages.
Taiwan Notice of Allowance with English translation issued in application 111105588 on Feb. 15, 2023, 4 pages.
Chinese Office Action with English translation issued in application 202210143311.8 on Jul. 14, 2023, 23 pages.
JaxJox Kettlebell Connect; accessed from https://web.archive.org/web/20190617075340/https://jaxjox.com/product/kettlebell-connect/ on Nov. 9, 2022, 7 pages.

* cited by examiner

SAFETY MECHANISM FOR AN ADJUSTABLE DUMBBELL

CROSS-REFERENCE TO RELATED APPLICATIONS

This application is a continuation of U.S. application Ser. No. 17/672,459, filed Feb. 15, 2022, which claims priority to and benefit of U.S. Provisional Patent Application No. 63/150,066, filed Feb. 16, 2021, which are hereby incorporated by reference in there entireties.

BACKGROUND

Background and Relevant Art

Kettlebells are used for a variety of aerobic and anaerobic exercise. A kettlebell typically consists of a large handle extending upward from a weight. The handle may be gripped with a single or two hands. Kettlebell exercise programs may involve the use of different weights of kettlebells. However, it may be cost and/or space prohibitive for an individual or small gym to own and/or store multiple kettlebells. Adjustable kettlebells may allow for a single kettlebell handle to have an adjustable weight, based on how many weight plates are connected to a kettlebell handle.

BRIEF SUMMARY

In some embodiments, a cradle for a kettlebell includes a drive shaft rotatable by a motor. A sensor toggle extends through a bore in the drive shaft and is longitudinally moveable between a first sensor toggle position and a second sensor toggle position. A position sensor determines whether the kettlebell is located in the cradle. A motor may rotate the drive shaft based on whether the position sensor determines that the kettlebell is located in the cradle.

In other embodiments, an adjustable kettlebell includes a handle having a handle bore therethrough. A selection mechanism includes a selection shaft and a dial extending into an indicator opening on the handle. The dial includes a dial key that is complementary to an opening key of the plurality of opening keys. When the dial is retracted into the opening, the dial key may prevent the selection mechanism from rotating and changing a weight of the adjustable kettlebell.

This summary is provided to introduce a selection of concepts that are further described below in the detailed description. This summary is not intended to identify key or essential features of the claimed subject matter, nor is it intended to be used as an aid in limiting the scope of the claimed subject matter.

Additional features and advantages of embodiments of the disclosure will be set forth in the description which follows, and in part will be obvious from the description, or may be learned by the practice of such embodiments. The features and advantages of such embodiments may be realized and obtained by means of the instruments and combinations particularly pointed out in the appended claims. These and other features will become more fully apparent from the following description and appended claims or may be learned by the practice of such embodiments as set forth hereinafter.

BRIEF DESCRIPTION OF THE DRAWINGS

In order to describe the manner in which the above-recited and other features of the disclosure can be obtained, a more particular description will be rendered by reference to specific implementations thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example implementations, the implementations will be described and explained with additional specificity and detail through the use of the accompanying drawings in which.

DETAILED DESCRIPTION

This disclosure generally relates to devices, systems, and methods for an adjustable kettlebell. The weight of the kettlebell may be adjusted when the kettlebell is placed in a cradle. A kettlebell safety feature may prevent the kettlebell from changing weights when it is not docked in the cradle. The kettlebell safety feature may include a dial rotatably connected to a weight selection mechanism. When the kettlebell is not docked in the cradle, the dial may be recessed within an indicator opening of the kettlebell. The dial may be keyed into the indicator opening such that the selection mechanism may not change the weight of the kettlebell until the kettlebell is placed in the cradle. When the kettlebell is placed in the cradle, the dial may be pushed out of the indicator opening, thereby allowing the selection mechanism to rotate and change weight of the kettlebell.

The cradle may further include a cradle safety mechanism. The cradle safety mechanism may include a hollow drive shaft. A position sensor may be located at a base of the hollow drive shaft. A toggle shaft may be located within the bore of the hollow drive shaft and connected to the position sensor. When the kettlebell is not located on the cradle, the position sensor may prevent the cradle from rotating the drive shaft. When the kettlebell is placed in the cradle, the toggle shaft may be pushed downward. This may cause the position sensor to detect the presence of the kettlebell. When the kettlebell is located in the cradle, the cradle may rotate the drive shaft to change the weight of the kettlebell.

Figure 1:
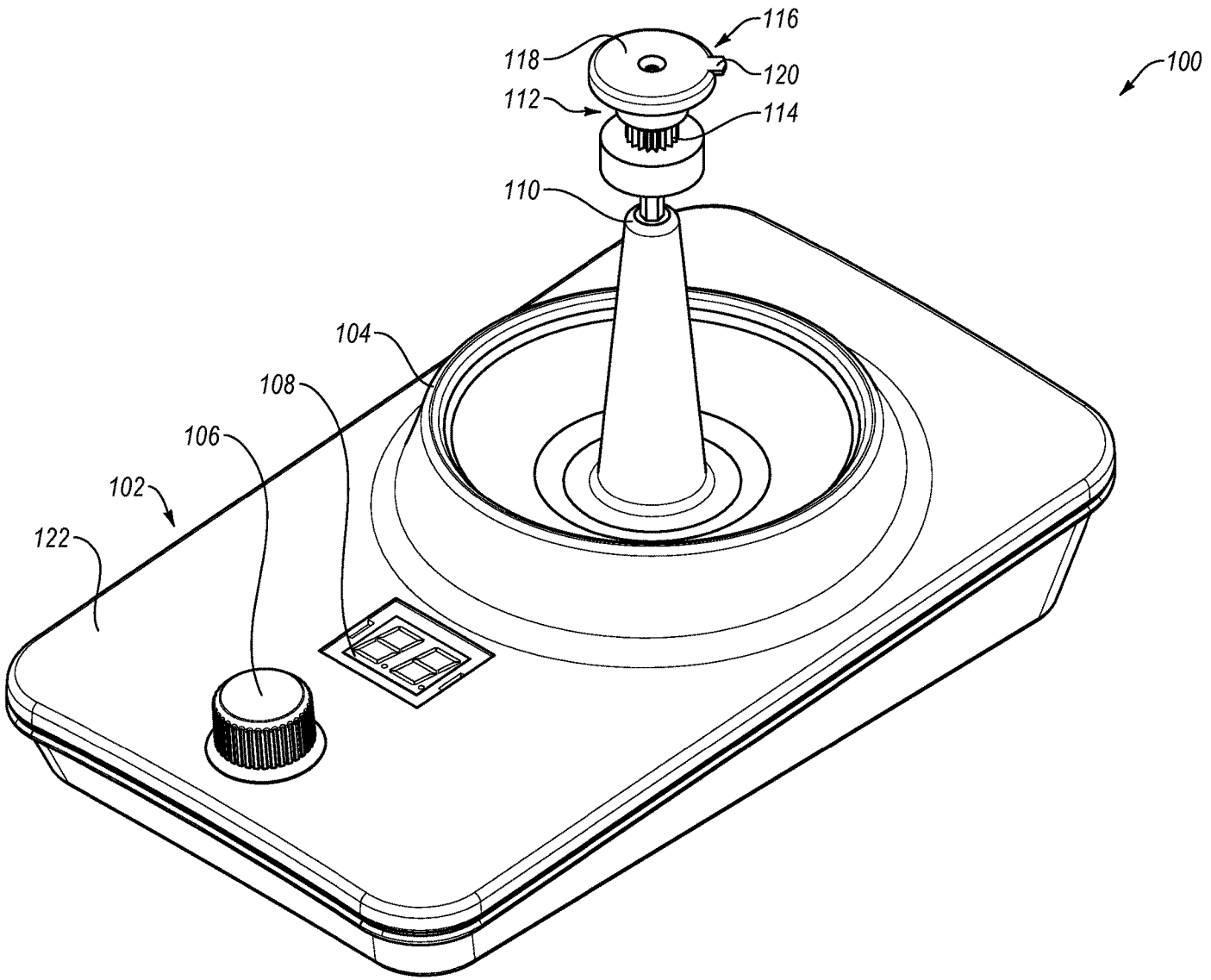
FIG. 1 is a representation of a perspective view of an adjustable kettlebell system, according to at least one embodiment of the present disclosure.

FIG. 1 is a representation of an adjustable kettlebell system 100, according to at least one embodiment of the present disclosure. The adjustable kettlebell system 100 includes a cradle 102 having a cradle seat 104. An adjustable kettlebell is configured to sit in the cradle seat 104 in a cradled position. While in the cradled position, (e.g., while the adjustable kettlebell is located in the cradle seat), the weight of the adjustable kettlebell may be changed.

To change the weight of the adjustable kettlebell, the user may provide an input to an input device 106 on the cradle 102. The input device 106 may be any type of input device. For example, in the embodiment shown, the input device 106 is a dial. However, it should be understood that the input device 106 may be any input device, including an alphanumeric keypad, one or more buttons, a digital touch-screen display, a toggle, a joystick, any other input device, and combinations thereof. A digital or analog display 108 may display the set weight of the kettlebell. The adjustable kettlebell may include a base and a plurality of selectively connectable plates.

When the user provides a weight input to the input device 106, a drive shaft 110 may be rotated by a pre-determined amount. The drive shaft 110 may rotate a selection mechanism 112 located inside the adjustable kettlebell. The selection mechanism 112 may include a selection gear 114 that is connected to connector plates. The selection gear 114 may extend and retract the connector plates transversely or perpendicularly to the rotational axis of the selection mechanism 112. The connector plates may engage with one or more weight plates to connect the weight plates to the adjustable kettlebell. The lateral position of the connector plates may determine the total connected weight of the adjustable kettlebell. Thus, rotating the drive shaft 110 by a pre-determined amount may move the connector plates by a pre-determined amount, thereby selectively adjusting the weight of the adjustable kettlebell.

The kettlebell system 100 may include one or more safety mechanisms. The safety mechanisms may help to prevent inadvertent changes in the selected weight of the adjustable kettlebell. This may help to prevent one or more weight plates from becoming dislodged during use of the adjustable kettlebell, thereby preventing injuries that may be caused by falling and flying weight plates. The kettlebell system 100 may include two or more multiple redundant safety mechanisms. Redundant safety mechanisms may help to further reduce the chance of an inadvertent change in weight of the adjustable kettlebell system 100.

The kettlebell system 100 may include a kettlebell safety mechanism 116. The kettlebell safety mechanism 116 may be a part of, or connected to, the selection mechanism 112. The kettlebell safety mechanism 116 may include a dial 118 rotationally fixed to the selection mechanism 112. In some embodiments, the dial 118 may be an indicator dial that provides a visual indication of the connected weight of the adjustable kettlebell. During use (e.g., in the uncradled position, when the adjustable kettlebell is not located in the seat 104), the dial 118 may be recessed in an indicator opening in an upper surface of the adjustable kettlebell.

As part of the kettlebell safety mechanism 116, the dial 118 may further include a dial key 120. The dial key 120 may include a protrusion or extension from an otherwise circular dial 118. The dial key 120 may be complementary to a plurality of opening keys in the indicator opening. When the selection mechanism 112 is rotated to set the adjustable kettlebell to a particular weight, the dial key 120 may be recessed within the indicator opening with the dial key 120 recessed within one of the opening keys. Thus, when the dial 118 is recessed within the indicator opening, the dial key 120 may prevent rotation of the selection mechanism 112. This may prevent the connector plates from extending or retracting relative to the selection gear, thereby reducing or preventing the inadvertent disconnection of a weight plate from the adjustable kettlebell.

The dial 118 may be longitudinally movable relative to the selection gear 114. As discussed herein, when the adjustable kettlebell is placed in the cradled position, the dial 118 may be extended out of the indicator opening. When the dial 118 is extended out of the indicator opening, rotation of the dial 118 may no longer be restrained by the interaction of the dial key 120 with the opening key. Thus, the selection mechanism 112 may be rotated and the weight of the adjustable kettlebell changed. In this manner, the weight of the adjustable kettlebell may be changed only when the adjustable kettlebell is in the cradled position (e.g., when the adjustable kettlebell is placed in the seat 104 of the cradle 102).

The kettlebell system 100 may include a cradle safety mechanism. The cradle safety mechanism may include a position sensor that senses when the adjustable kettlebell is located in the cradled position. When the position sensor determines that the adjustable kettlebell is located in the cradled position, a cradle motor may be unlocked such that the drive shaft 110 may be rotated. When the position sensor determines that the adjustable kettlebell is not located in the cradled position, the cradle motor may be locked such that the drive shaft 110 may not be rotated. In this manner, the cradle safety mechanism may help to prevent inadvertent rotation of the drive shaft 110. This may help to ensure that the weight indicated by the input device 106 and/or the display 108 is the actual connected weight of the adjustable kettlebell. This may help to improve the exercise experience and reduce user frustration with a mismatch between the indicated and the actual weight.

In some embodiments, the cradle safety mechanism may be located within a body 122 of the cradle 102. For example, as discussed herein, the position sensor may be a sensor that is physically toggled by a toggle shaft longitudinally movable relative to the drive shaft 110. The toggle shaft may be extended downward when the adjustable kettlebell is installed in the cradled position, thereby indicating the presence of the adjustable kettlebell in the seat 104 of the cradle 102.

Figure 2:
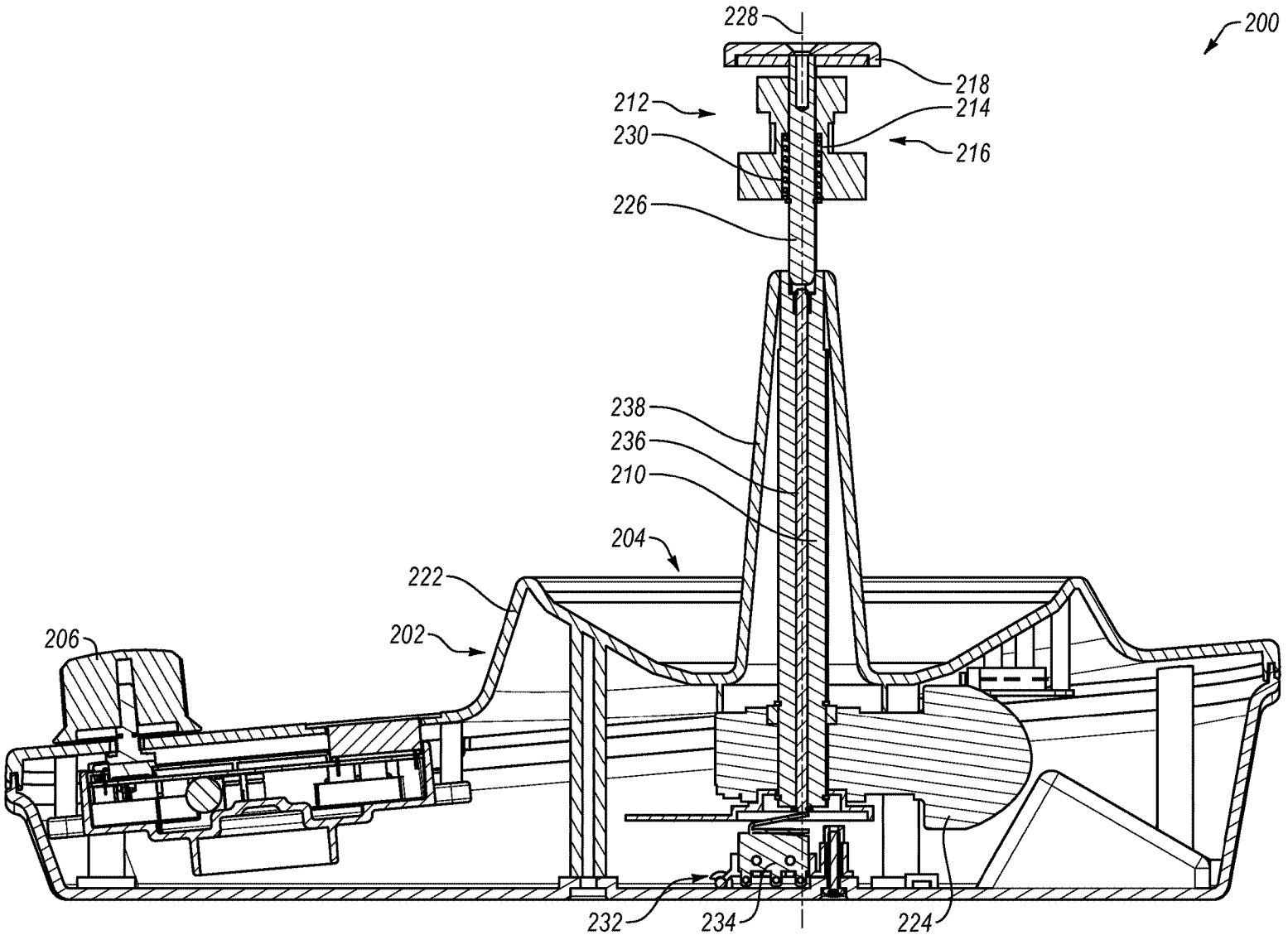
FIG. 2 is a representation of a cross-sectional view of an adjustable kettlebell system, according to at least one embodiment of the present disclosure.

FIG. 2 is a cross-sectional side view of a representation of an adjustable kettlebell system 200, according to at least one embodiment of the present disclosure. The adjustable kettlebell system 200 includes a cradle 202. When a kettlebell is placed in a cradled position in the cradle 202, the weight of the kettlebell may be changed. To change the weight, the user may provide input to an input device 206. When the kettlebell is in the cradled position, changing the input device 206 may cause a motor 224 to rotate a drive shaft 210 about a longitudinal axis 228 (e.g., a rotation axis). The drive shaft 210 may be rotationally connected to a selection mechanism. The drive shaft 210 may rotate a selection shaft 226 about the longitudinal axis 228. The selection shaft 226 may cause a selection gear 214 to rotate about the longitudinal axis 228, thereby causing one or more connector plates to engage with one or more weight plates, thereby selectively connecting and disconnecting the weight plates to the handle of the kettlebell, based on the rotational position of the selection gear 214. As may be seen, the rotational position of the selection gear 214 is determined based on the rotational position of the drive shaft 210. Thus, the adjustable kettlebell system 200 may adjust the weight of the adjustable kettlebell based on the rotational position of the drive shaft 210.

In some embodiments, the adjustable kettlebell system 200 may include one or more safety mechanisms to prevent inadvertent rotations connection and disconnection of weight plates to the kettlebell handle. In some embodiments, a kettlebell safety mechanism 216 may be included in the kettlebell handle. In some embodiments, the kettlebell safety mechanism 216 may be a part of the selection mechanism 212. In some embodiments, the kettlebell safety mechanism 216 may include the drive shaft 226. The selection shaft 226 may be longitudinally movable parallel to the longitudinal axis 228. The selection shaft 226 may be rigidly (e.g., rotationally and translationally) connected to a dial 218. Thus, as the selection shaft 226 is rotated, the dial 218 may be rotated. Furthermore, as the selection shaft 226 moves parallel to the longitudinal axis 228, the dial 218 may move parallel to the longitudinal axis.

In some embodiments, the entire selection mechanism 212 may move longitudinally (e.g., parallel or approximately parallel to the longitudinal axis 228) when the selection shaft 226 moves longitudinally. In some embodiments, the selection gear 214 may include a selection gear bore, and the selection shaft 226 may be longitudinally movable through the selection gear bore. In this manner, the selection gear 214 may remain in contact with the connector plates when the adjustable kettlebell is placed in the cradle 202.

In some embodiments, when the adjustable kettlebell is placed into the cradled position in the cradle 202, the drive shaft 210 may push on the selection shaft 226. This may cause the selection shaft 226 to move longitudinally upwards. In some embodiments, the longitudinal movement of the selection shaft 226 may cause the dial 218 to move (e.g., extend) out of the indicator opening in the kettlebell handle. This may cause the dial key (e.g., the dial key 120 of FIG. 1) to extend out of the kettlebell handle, thereby allowing the selection mechanism 212 to be rotated and the weight of the adjustable kettlebell to be changed. When the adjustable kettlebell is removed from the cradle 202 (e.g., when the adjustable kettlebell is in the uncradled position), the selection shaft 226 and the dial 218 may retract into the indicator opening of the adjustable kettlebell handle. In some embodiments, a resilient member 230, such as a spring or an elastically deformable material, may urge the selection shaft 226 and the dial 218 to retract into the indicator opening of the adjustable kettlebell handle.

In the embodiment shown, the drive shaft 210 may push on the selection shaft 226. However, it should be understood that different elements of the cradle 202 may push on the selection shaft 226. For example, a portion of the cradle seat 204 may push on the selection shaft 226. In some examples, a body 222 of the cradle 202 may include a shell 238 surrounding the drive shaft 210, and the shell 238 may push on the selection shaft 226.

In this manner, the weight of the adjustable kettlebell may not be changed unless the adjustable kettlebell is in the cradled position. This may help to prevent inadvertent removal of weight plates from the kettlebell during an exercise activity. This may further help to further maintain alignment of the selection mechanism 212 with the remaining weight plates in the cradle 202.

In some embodiments, the adjustable kettlebell system 200 may include a cradle safety mechanism 232. The cradle safety mechanism 232 may sense the presence of the kettlebell in the cradle 202. If the kettlebell is not located in the cradle 202 (e.g., if the kettlebell is in the uncradled position), then the cradle safety mechanism 232 may prevent the drive shaft 210 from rotating. If the kettlebell is located in the cradle 202 (e.g., if the kettlebell is in the cradled position), then the cradle safety mechanism 232 may allow the drive shaft 210 to rotate and change the weight of the adjustable kettlebell.

The cradle safety mechanism 232 may include a position sensor 234. The position sensor 234 may sense whether the adjustable kettlebell is located in the cradle. In some embodiments, the position sensor 234 may be actuated or toggled by a sensor toggle 236. When the adjustable kettlebell is placed in the cradle, the sensor toggle 236 may be triggered or depressed. This may toggle the sensor 234 to determine that the adjustable kettlebell is in the cradled position. If the sensor toggle 236 is not triggered or depressed, then the sensor 234 may determine that the adjustable kettlebell is in the uncradled position.

In some embodiments, the sensor toggle 236 may be a shaft that extends in the longitudinal direction (e.g., parallel and/or coaxial to the longitudinal axis 228). When the adjustable kettlebell is placed in the cradled position, the selection shaft 226 may depress the sensor toggle 236, causing it to travel in the longitudinal direction (e.g., parallel to the longitudinal axis 228) until it toggles the position sensor 234. In some embodiments, the sensor toggle 236 may be the drive shaft 210. In some embodiments, the sensor toggle 236 may be a shaft that extends through the drive shaft 210.

In the embodiment shown, the selection shaft 226 may depress the sensor toggle 236. However, it should be understood that any other portion of the adjustable kettlebell handle may depress the sensor toggle 236. For example, the body of the kettlebell handle may depress the sensor toggle.

In some embodiments, the position sensor 234 may be any type of sensor. For example, the position sensor 234 may be a weight sensor. For example, the position sensor 234 may measure a total weight of elements located in the cradle seat 204. The position sensor 234 may know the combined weight of the kettlebell handle and each weight plate. If the position sensor 234 determines that the weight in the cradle is equal to the combined weight, the position sensor 234 may determine that the adjustable kettlebell is located in the cradle 202. If the position sensor 234 determines that the weight in the cradle is less than the combined weight, the position sensor 234 may determine that the adjustable kettlebell is not located in the cradle 202.

In some embodiments, the adjustable kettlebell system 200 may include only the kettlebell safety mechanism 212 or the cradle safety mechanism 232. In some embodiments, the adjustable kettlebell system 200 may include both the kettlebell safety mechanism 212 and the cradle safety mechanism 232. In some embodiments, the selection shaft 226 may depress the sensor toggle 236, and the sensor toggle 236 may extend the selection shaft 226. This may add redundancy to the safety mechanisms of the adjustable kettlebell system. This may further prevent inadvertent rotation of the drive shaft 210, thereby reducing a potential mismatch between the user-inputted or selected weight and the actual connected weight of the adjustable kettlebell.

Figure 3:
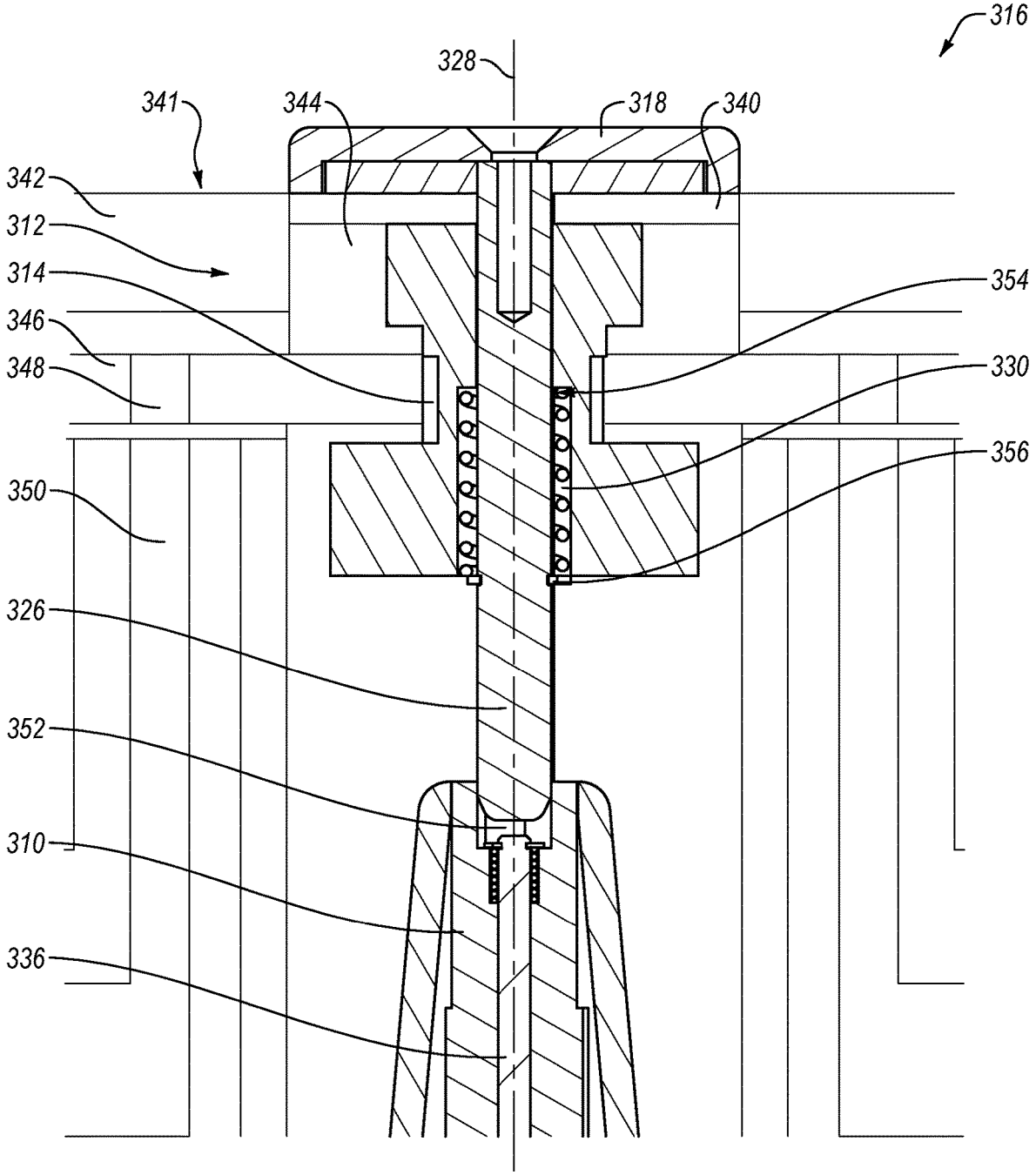
FIG. 3 is a representation of a cross-sectional view of a kettlebell safety mechanism, according to at least one embodiment of the present disclosure.

FIG. 3 is a representation of a cross-sectional view of a kettlebell safety mechanism 316 with the kettlebell in the cradled position, according to at least one embodiment of the present disclosure. In the cradled position shown, the kettlebell safety mechanism 316 includes a dial 318 that is extended out of an indicator opening 340 in an upper surface 341 of a kettlebell handle 342. When the dial 318 is extended out of the indicator opening 340, the dial 318 may be freely rotated relative to the kettlebell handle 342. This may allow a change to the number of weights connected to the kettlebell handle 342, thereby changing the weight of the adjustable kettlebell.

In the embodiment shown, a selection mechanism 312 extends through a handle bore 344 in the kettlebell handle 342. The selection mechanism 312 may include a selection shaft 326 rotationally connected to a selection gear 314. The selection gear 314 may be connected to one or more connector plates 346. The connector plates 346 may be laterally movable (e.g., transverse or perpendicular to the longitudinal axis 328) (e.g., the rotational axis of the selection gear 314 and/or the selection shaft 326) as the selection gear 314 rotates. The connector plates 346 may include a connector tab 348. The connector plate may engage with a slot in a weight plate 350. When the kettlebell handle 342 is placed in the uncradled position, the connector tab 348 may engage with the slot in the weight plate 350, thereby connecting the weight plate 350 to the kettlebell handle 342. As may be seen, the connected weight plate 350 may lift any weight plates resting on top of the connected weight plate 350. Thus, to increase the weight of the adjustable kettlebell, the connector plate 346 may be moved inward (e.g., toward the selection shaft 326) to engage the connector tab 348 with a weight plate that supports more weight plates. To decrease the weight of the adjustable kettlebell, the connector plate 346 may be moved outward to engage the connector tab 348 with a weight plate that supports fewer weight plates.

The selection shaft 326 may be rotated by a drive shaft 310 of a cradle (e.g., the cradle 202 of FIG. 2). The selection shaft 326 may be inserted into a keyed slot 352 at an end of the drive shaft. The keyed slot 352 may be complementarily shaped to the selection shaft 326 such that, when the selection shaft 326 is inserted into the keyed slot 352, the keyed slot 352 may engage the selection shaft 326 to rotate it. For example, the selection shaft 326 may be hexagonally shaped and the keyed slot 352 may have a complementary hexagonal shape to receive the selection shaft 326.

In the embodiment shown, the selection gear 314 includes a selection gear bore 354 therethrough. The selection shaft 326 may be inserted into the selection gear bore 354. The selection gear bore 354 may have a complementary shape to the selection shaft 326. Thus, the selection shaft 326 may be rotatably connected to the selection gear bore 354. Furthermore, the selection shaft 326 may be longitudinally movable (e.g., movable along and/or parallel to the longitudinal axis 328) through the selection gear bore 354.

When the kettlebell handle 342 is in the cradled position shown, the drive shaft 310 and/or a sensor toggle 336 in the drive shaft 310 may push on the selection shaft 326. This may cause the selection shaft 326 to move (e.g., slide or translate) in the longitudinal direction through the selection gear 314 via the selection gear bore. This may push the dial 318 out of the indicator opening 340, thereby allowing the selection gear 314 to rotate and change which weight plate is connected to the connector plate 346. In this manner, the weight of the adjustable kettlebell may be changed when the adjustable kettlebell is in the cradled position.

In some embodiments, the kettlebell safety mechanism 316 may include a resilient member 330. The resilient member 330 may push against a stop-ring 356 connected to the selection shaft 326. When the adjustable kettlebell is moved into the uncradled position, the resilient member 330 may push on the selection gear 314 to move the dial 318 back into the retracted position. As discussed herein, this may cause a dial key to engage with an opening key, thereby preventing the dial 318, and therefore the entire selection mechanism 312, from rotating. This may prevent a change in the position of the connector plate, thereby preventing an inadvertent change in which weight plates 350 are connected to the kettlebell handle 342. This may increase the safety of the adjustable kettlebell by reducing the chance of injury based on a falling or flying weight plate 350.

Figure 4:
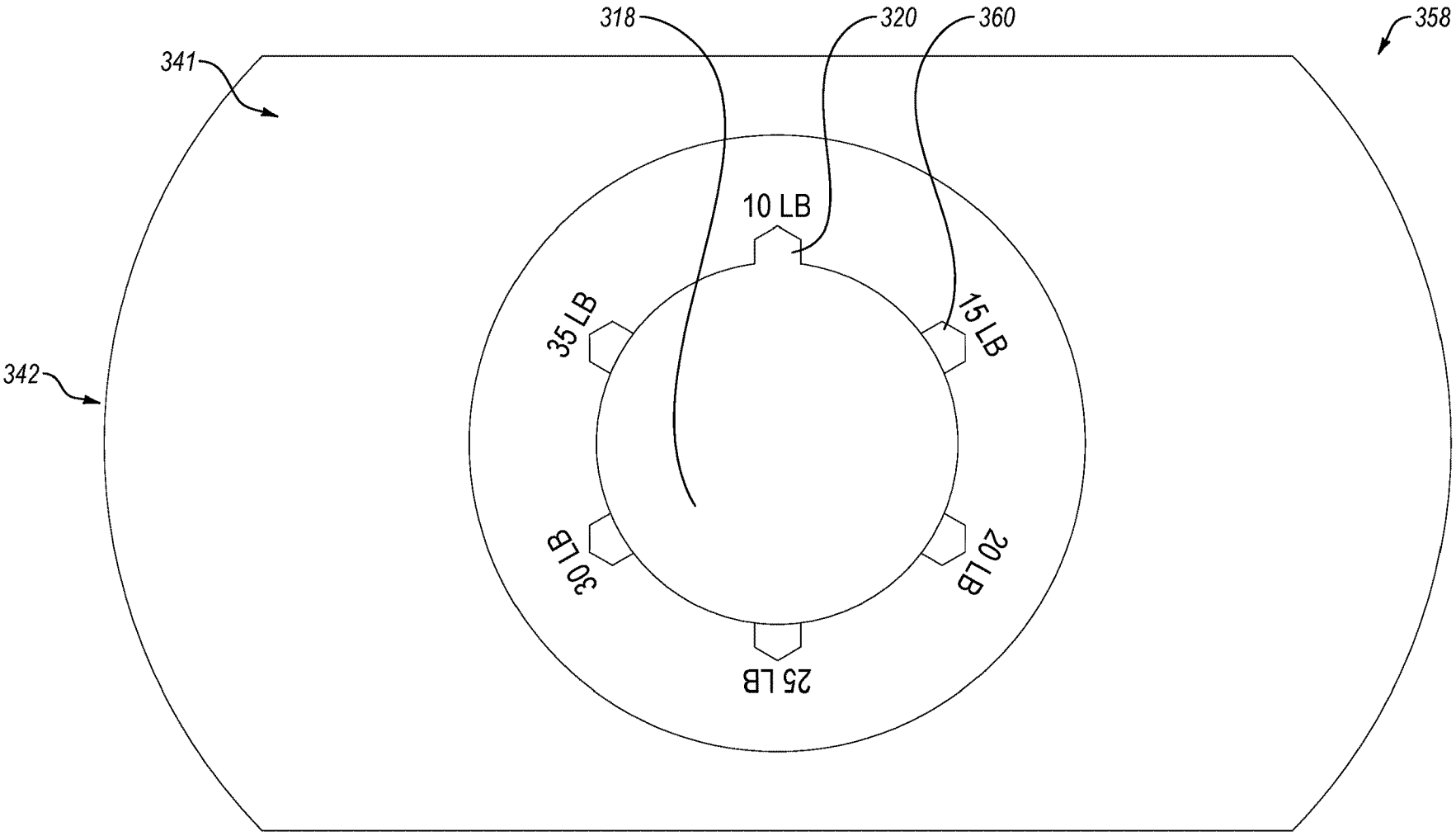
FIG. 4 is a representation of a top-down view of a dial in a kettlebell handle, according to at least one embodiment of the present disclosure.

FIG. 4 is a representation of a top-down view of an upper surface 341 of a kettlebell handle 342 of an adjustable kettlebell 358, according to at least one embodiment of the present disclosure. In the embodiment shown, an indicator opening 341 opens into the upper surface 341 of the kettlebell handle 342. The indicator opening 341 includes a plurality of opening keys 360.

A dial 318 may be inserted into the indicator opening 341. The dial 318 may include a dial key 320 that protrudes or extends from the outer circumference of the dial 318. The dial key 320 may be complementary to each opening key 360. In the retracted position of the dial 318, the dial key 320 may be inserted into one of the opening keys 360. As may be seen, due to the interference between the dial key 320 and the opening key 360, the dial 318 may not be rotated. Because the dial 318 is rotationally connected to the selection mechanism (e.g., the selection mechanism 312 of FIG. 3), this may prevent the selection mechanism from rotating, thereby preventing a change in weight to the adjustable kettlebell 358.

Figure 5:
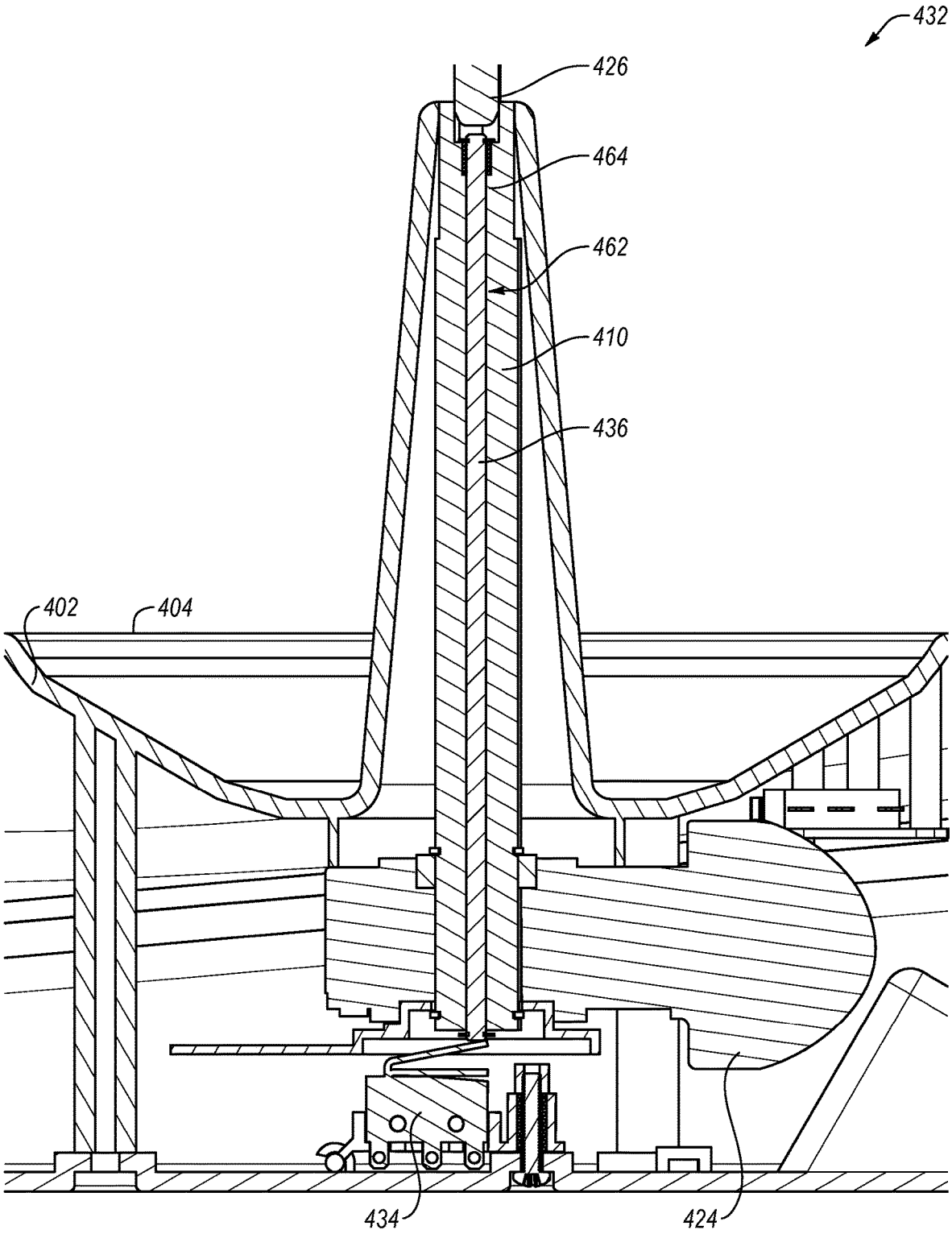
FIG. 5 is a representation of a cross-sectional view of a cradle safety mechanism, according to at least one embodiment of the present disclosure.

FIG. 5 is a representation of a cross-sectional view of a cradle safety mechanism 432, according to at least one embodiment of the present disclosure. The cradle safety mechanism 432 may include a position sensor 434. The position sensor 434 may be toggled when an adjustable kettlebell is placed in the seat 404 of the cradle 402. When the position sensor 434 is toggled, a motor 424 may be allowed to rotate a drive shaft 410. The drive shaft 410 may be rotationally connected to a selector shaft 426 of a selection mechanism (e.g., the selection mechanism 316 of FIG. 3). Rotating the drive shaft 410 may cause the weight of the adjustable kettlebell to change. Thus, by toggling the position sensor 434, the motor 424 may rotate the selection shaft 426 to change the weight of the adjustable kettlebell.

In some embodiments, a weight adjustment system of the cradle 402 may determine the connected weight of the adjustable kettlebell based on the rotational position of the drive shaft 410. Rotation of the drive shaft 410 while the adjustable kettlebell is in the uncradled position may cause the weight adjustment system of the cradle 402 to determine that the connected weight of the adjustable kettlebell is different than the actual connected weight. This may lead to user frustration and a decreased user experience based on the discrepancy in determined weight to the actual connected weight. To prevent unintended rotation of the drive shaft 410, when the adjustable kettlebell is in the uncradled position, the position sensor 434 may prevent the motor 424 from rotating the drive shaft. This may help to ensure that the determined weight of the adjustable kettlebell matches the actual weight of the adjustable kettlebell.

In some embodiments, the position sensor 434 may be toggled using a sensor toggle 436 longitudinally movable between a first sensor toggle position and a second sensor toggle position. The drive shaft 410 may include a drive shaft bore 462 extending therethrough. The sensor toggle 436 may be a shaft that extends through the drive shaft bore 462. The sensor toggle 436 may be longitudinally movable relative to the drive shaft 410. When the sensor toggle 436 is pushed downward relative to the drive shaft 410 into the first sensor toggle position, the position sensor 434 may determine that the adjustable kettlebell is in the cradled position. When the sensor toggle 436 is located upward relative to the drive shaft 410 in the second sensor toggle position, position sensor 434 may determine that the adjustable kettlebell is in the uncradled position.

The adjustable kettlebell may move the sensor toggle 436 into the first sensor toggle position such that the position sensor 434 determines that the adjustable kettlebell is in the cradled position. In some embodiments, when the adjustable kettlebell is placed in the cradled position, the selection shaft 426 may press down on the sensor toggle 436 to toggle the position sensor 434. When the adjustable kettlebell is removed from the cradle 402 (e.g., when the adjustable kettlebell is moved into the uncradled position), a resilient member 464 may urge the position sensor 434 back into the second sensor toggle position.

In some embodiments, the position sensor 434 may be connected to a control circuit. When the user provides an input to change the weight of the adjustable kettlebell, if the position sensor 434 determines that the adjustable kettlebell is in the cradled position, the control circuit may provide instructions to the motor 424 to rotate the drive shaft 410. If the position sensor 434 determines that the adjustable kettlebell is in the uncradled position, the control circuit may provide instructions to the motor 424 to not rotate the drive shaft 410.

In some embodiments, the position sensor 434 may be part of a power circuit of the motor 424. In some embodiments, when the sensor toggle 436 is depressed by the selection shaft 426 (e.g., when the sensor toggle 436 is in the first sensor toggle position), the sensor toggle 436 may close the power circuit, thereby allowing the motor 424 to rotate the drive shaft 410. When the sensor toggle 436 is not depressed (e.g., when the sensor toggle 436 is in the second sensor toggle position), the motor 424 may not receive power, and the drive shaft 410 may not be rotated.

Figure 6:
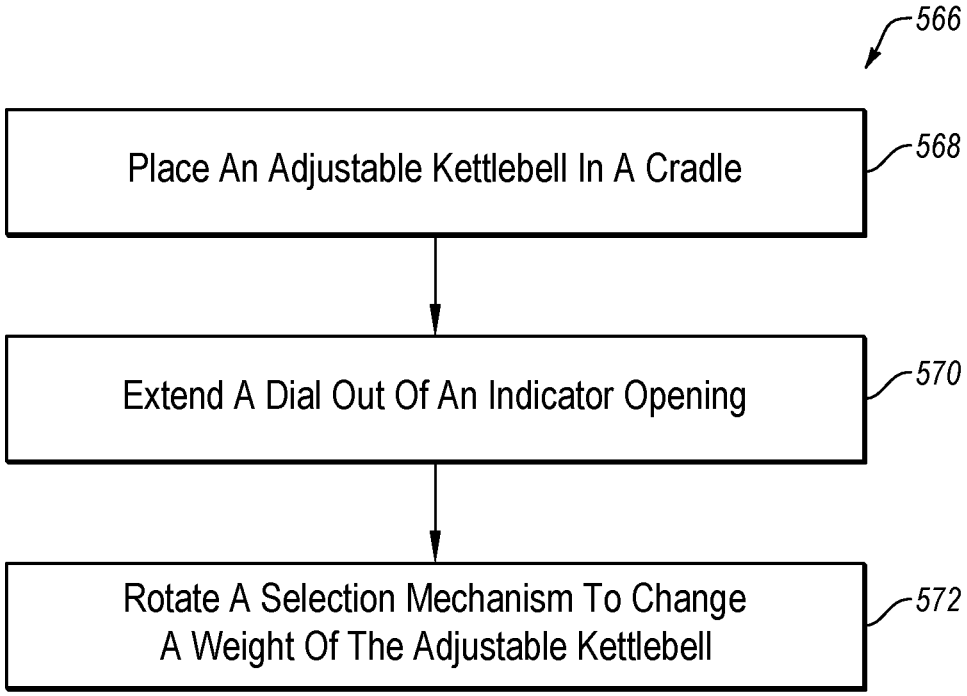
FIG. 6 is a representation of a method for locking an adjustable kettlebell, according to at least one embodiment of the present disclosure.

FIG. 6 is a representation of a method 566 for locking an adjustable kettlebell, according to at least one embodiment of the present disclosure. The method 566 may include placing an adjustable kettlebell in a cradle at 568. When the adjustable kettlebell is placed in the cradle, a dial may be extended out of an indicator opening at 570. When the dial is retracted in the indicator opening, a dial key may be recessed into an indicator key, thereby preventing the dial and a selection mechanism from rotating. When the dial and the dial key are extended out of the indicator opening and the opening key, a selection mechanism rotationally connected to the dial may be rotated to change a weight of the adjustable kettlebell at 572.

The method may further include removing the adjustable kettlebell from the cradle. When the adjustable kettlebell is removed from the cradle, the dial may be retracted into the indicator opening such that the dial key is inserted back into an indicator key.

Figure 7:
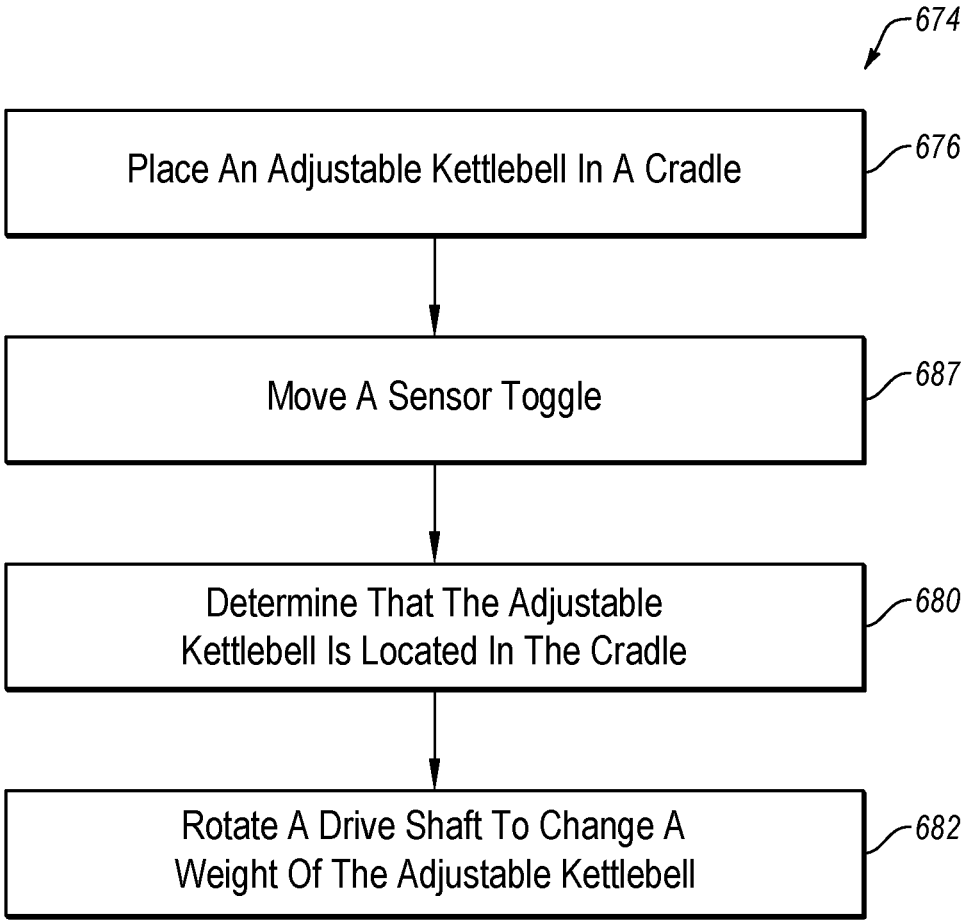
FIG. 7 is a representation of a method for adjusting a weight of an adjustable kettlebell, according to at least one embodiment of the present disclosure.

FIG. 7 is a representation of a method 674 for adjusting a weight of an adjustable kettlebell, according to at least one embodiment of the present disclosure. The method 674 may include placing an adjustable kettlebell in a cradle at 676. Placing the adjustable kettlebell in the cradle may move a sensor toggle from a second sensor toggle position to a first sensor toggle position at 678. When the sensor toggle is moved to the first sensor toggle position, a position sensor may determine that the adjustable kettlebell is located in the cradle at 680. A drive shaft may then be rotated to change a weight of the adjustable kettlebell at 682.

The method 674 may further include removing the adjustable kettlebell from the cradle. This may cause the sensor toggle to move from the first sensor toggle position to the second sensor toggle position. The position sensor may then determine that the adjustable kettlebell is not located in the cradle based on the sensor toggle being in the second sensor toggle position. The cradle may then receive an input to change the weight of the adjustable kettlebell. However, when the position sensor determines that the adjustable kettlebell is not in the cradle, the motor may be prevented from rotating the drive shaft.

INDUSTRIAL APPLICABILITY

This disclosure generally relates to devices, systems, and methods for an adjustable kettlebell. The weight of the kettlebell may be adjusted when the kettlebell is placed in a cradle. A kettlebell safety feature may prevent the kettlebell from changing weights when it is not docked in the cradle. The kettlebell safety feature may include a dial rotatably connected to a weight selection mechanism. When the kettlebell is not docked in the cradle, the dial may be recessed within an indicator opening of the kettlebell. The dial may be keyed into the indicator opening such that the selection mechanism may not change the weight of the kettlebell until the kettlebell is placed in the cradle. When the kettlebell is placed in the cradle, the dial may be pushed out of the indicator opening, thereby allowing the selection mechanism to rotate and change weight of the kettlebell.

The cradle may further include a cradle safety mechanism. The cradle safety mechanism may include a hollow drive shaft. A position sensor may be located at a base of the hollow drive shaft. A toggle shaft may be located within the bore of the hollow drive shaft and connected to the position sensor. When the kettlebell is not located on the cradle, the position sensor may prevent the cradle from rotating the drive shaft. When the kettlebell is placed in the cradle, the toggle shaft may be pushed downward. This may cause the position sensor to detect the presence of the kettlebell. When the kettlebell is located in the cradle, the cradle may rotate the drive shaft to change the weight of the kettlebell.

In some embodiments, an adjustable kettlebell system includes a cradle having a cradle seat. An adjustable kettlebell is configured to sit in the cradle seat in a cradled position. While in the cradled position, (e.g., while the adjustable kettlebell is located in the cradle seat), the weight of the adjustable kettlebell may be changed.

To change the weight of the adjustable kettlebell, the user may provide an input to an input device on the cradle. The input device may be any type of input device. For example, in the embodiment shown, the input device is a dial. However, it should be understood that the input device may be any input device, including an alphanumeric keypad, one or more buttons, a digital touch-screen display, a toggle, a joystick, any other input device, and combinations thereof. A digital or analog display may display the set weight of the kettlebell. The adjustable kettlebell may include a base and a plurality of selectively connectable plates.

When the user provides a weight input to the input device, a drive shaft may be rotated by a pre-determined amount. The drive shaft may rotate a selection mechanism located inside the adjustable kettlebell. The selection mechanism may include a selection gear that is connected to connector plates. The selection gear may extend and retract the connector plates transversely or perpendicularly to the rotational axis of the selection mechanism. The connector plates may engage with one or more weight plates to connect the weight plates to the adjustable kettlebell. The lateral position of the connector plates may determine the total connected weight of the adjustable kettlebell. Thus, rotating the drive shaft by a pre-determined amount may move the connector plates by a pre-determined amount, thereby selectively adjusting the weight of the adjustable kettlebell.

The kettlebell system may include one or more safety mechanisms. The safety mechanisms may help to prevent inadvertent changes in the selected weight of the adjustable kettlebell. This may help to prevent one or more weight plates from becoming dislodged during use of the adjustable kettlebell, thereby preventing injuries that may be caused by falling and flying weight plates. The kettlebell system may include two or more multiple redundant safety mechanisms. Redundant safety mechanisms may help to further reduce the chance of an inadvertent change in weight of the adjustable kettlebell system.

The kettlebell system may include a kettlebell safety mechanism. The kettlebell safety mechanism may be a part of, or connected to, the selection mechanism. The kettlebell safety mechanism may include a dial rotationally fixed to the selection mechanism. In some embodiments, the dial may be an indicator dial that provides a visual indication of the connected weight of the adjustable kettlebell. During use (e.g., in the uncradled position, when the adjustable kettlebell is not located in the seat), the dial may be recessed in an indicator opening in an upper surface of the adjustable kettlebell.

As part of the kettlebell safety mechanism, the dial may further include a dial key. The dial key may include a protrusion or extension from an otherwise circular dial. The dial key may be complementary to a plurality of opening keys in the indicator opening. When the selection mechanism is rotated to set the adjustable kettlebell to a particular weight, the dial key may be recessed within the indicator opening with the dial key recessed within one of the opening keys. Thus, when the dial is recessed within the indicator opening, the dial key may prevent rotation of the selection mechanism. This may prevent the connector plates from extending or retracting relative to the selection gear, thereby reducing, or preventing the inadvertent disconnection of a weight plate from the adjustable kettlebell.

The dial may be longitudinally movable relative to the selection gear. As discussed herein, when the adjustable kettlebell is placed in the cradled position, the dial may be extended out of the indicator opening. When the dial is extended out of the indicator opening, rotation of the dial may no longer be restrained by the interaction of the dial key with the opening key. Thus, the selection mechanism may be rotated and the weight of the adjustable kettlebell changed. In this manner, the weight of the adjustable kettlebell may be changed only when the adjustable kettlebell is in the cradled position (e.g., when the adjustable kettlebell is placed in the seat of the cradle).

The kettlebell system may include a cradle safety mechanism. The cradle safety mechanism may include a position sensor that senses when the adjustable kettlebell is located in the cradled position. When the position sensor determines that the adjustable kettlebell is located in the cradled position, a cradle motor may be unlocked such that the drive shaft may be rotated. When the position sensor determines that the adjustable kettlebell is not located in the cradled position, the cradle motor may be locked such that the drive shaft may not be rotated. In this manner, the cradle safety mechanism may help to prevent inadvertent rotation of the drive shaft. This may help to ensure that the weight indicated by the input device and/or the display is the actual connected weight of the adjustable kettlebell. This may help to improve the exercise experience and reduce user frustration with a mismatch between the indicated and the actual weight.

In some embodiments, the cradle safety mechanism may be located within a body of the cradle. For example, as discussed herein, the position sensor may be a sensor that is physically toggled by a toggle shaft longitudinally movable relative to the drive shaft. The toggle shaft may be extended downward when the adjustable kettlebell is installed in the cradled position, thereby indicating the presence of the adjustable kettlebell in the seat of the cradle.

When a kettlebell is placed in a cradled position in the cradle, the weight of the kettlebell may be changed. To change the weight, the user may provide input to an input device. When the kettlebell is in the cradled position, changing the input device may cause a motor to rotate a drive shaft about a longitudinal axis (e.g., a rotation axis). The drive shaft may be rotationally connected to a selection mechanism. The drive shaft may rotate a selection shaft about the longitudinal axis. The selection shaft may cause a selection gear to rotate about the longitudinal axis, thereby causing one or more connector plates to engage with one or more weight plates, thereby selectively connecting and disconnecting the weight plates to the handle of the kettlebell, based on the rotational position of the selection gear. As may be seen, the rotational position of the selection gear is determined based on the rotational position of the drive shaft. Thus, the adjustable kettlebell system may adjust the weight of the adjustable kettlebell based on the rotational position of the drive shaft.

In some embodiments, the adjustable kettlebell system may include one or more safety mechanisms to prevent inadvertent rotations connection and disconnection of weight plates to the kettlebell handle. In some embodiments, a kettlebell safety mechanism may be included in the kettlebell handle. In some embodiments, the kettlebell safety mechanism may be a part of the selection mechanism. In some embodiments, the kettlebell safety mechanism may include the drive shaft. The selection shaft may be longitudinally movable parallel to the longitudinal axis. The selection shaft may be rigidly (e.g., rotationally and translationally) connected to a dial. Thus, as the selection shaft is rotated, the dial may be rotated. Furthermore, as the selection shaft moves parallel to the longitudinal axis, the dial may move parallel to the longitudinal axis.

In some embodiments, the entire selection mechanism may move longitudinally (e.g., parallel or approximately parallel to the longitudinal axis) when the selection shaft moves longitudinally. In some embodiments, the selection gear may include a selection gear bore, and the selection shaft may be longitudinally movable through the selection gear bore. In this manner, the selection gear may remain in contact with the connector plates when the adjustable kettlebell is placed in the cradle.

In some embodiments, when the adjustable kettlebell is placed into the cradled position in the cradle, the drive shaft may push on the selection shaft. This may cause the selection shaft to move longitudinally upwards. In some embodiments, the longitudinal movement of the selection shaft may cause the dial to move (e.g., extend) out of the indicator opening in the kettlebell handle. This may cause the dial key to extend out of the kettlebell handle, thereby allowing the selection mechanism to be rotated and the weight of the adjustable kettlebell to be changed. When the adjustable kettlebell is removed from the cradle (e.g., when the adjustable kettlebell is in the uncradled position), the selection shaft and the dial may retract into the indicator opening of the adjustable kettlebell handle. In some embodiments, a resilient member, such as a spring or an elastically deformable material, may urge the selection shaft and the dial to retract into the indicator opening of the adjustable kettlebell handle.

In the embodiment shown, the drive shaft may push on the selection shaft. However, it should be understood that different elements of the cradle may push on the selection shaft. For example, a portion of the cradle seat may push on the selection shaft. In some examples, a body of the cradle may include a shell surrounding the drive shaft, and the shell may push on the selection shaft.

In this manner, the weight of the adjustable kettlebell may not be changed unless the adjustable kettlebell is in the cradled position. This may help to prevent inadvertent removal of weight plates from the kettlebell during an exercise activity. This may further help to further maintain alignment of the selection mechanism with the remaining weight plates in the cradle.

In some embodiments, the adjustable kettlebell system may include a cradle safety mechanism. The cradle safety mechanism may sense the presence of the kettlebell in the cradle. If the kettlebell is not located in the cradle (e.g., if the kettlebell is in the uncradled position), then the cradle safety mechanism may prevent the drive shaft from rotating. If the kettlebell is located in the cradle (e.g., if the kettlebell is in the cradled position), then the cradle safety mechanism may allow the drive shaft to rotate and change the weight of the adjustable kettlebell.

The cradle safety mechanism may include a position sensor. The position sensor may sense whether the adjustable kettlebell is located in the cradle. In some embodiments, the position sensor may be actuated or toggled by a sensor toggle. When the adjustable kettlebell is placed in the cradle, the sensor toggle may be triggered or depressed. This may toggle the sensor to determine that the adjustable kettlebell is in the cradled position. If the sensor toggle is not triggered or depressed, then the sensor may determine that the adjustable kettlebell is in the uncradled position.

In some embodiments, the sensor toggle may be a shaft that extends in the longitudinal direction (e.g., parallel and/or coaxial to the longitudinal axis). When the adjustable kettlebell is placed in the cradled position, the selection shaft may depress the sensor toggle, causing it to travel in the longitudinal direction (e.g., parallel to the longitudinal axis) until it toggles the position sensor. In some embodiments, the sensor toggle may be the drive shaft. In some embodiments, the sensor toggle may be a shaft that extends through the drive shaft.

In the embodiment shown, the selection shaft may depress the sensor toggle. However, it should be understood that any other portion of the adjustable kettlebell handle may depress the sensor toggle. For example, the body of the kettlebell handle may depress the sensor toggle.

In some embodiments, the position sensor may be any type of sensor. For example, the position sensor may be a weight sensor. For example, the position sensor may measure a total weight of elements located in the cradle seat. The position sensor may know the combined weight of the kettlebell handle and each weight plate. If the position sensor determines that the weight in the cradle is equal to the combined weight, the position sensor may determine that the adjustable kettlebell is located in the cradle. If the position sensor determines that the weight in the cradle is less than the combined weight, the position sensor may determine that the adjustable kettlebell is not located in the cradle.

In some embodiments, the adjustable kettlebell system may include only the kettlebell safety mechanism or the cradle safety mechanism. In some embodiments, the adjustable kettlebell system may include both the kettlebell safety mechanism and the cradle safety mechanism. In some embodiments, the selection shaft may depress the sensor toggle, and the sensor toggle may extend the selection shaft. This may add redundancy to the safety mechanisms of the adjustable kettlebell system. This may further prevent inadvertent rotation of the drive shaft, thereby reducing a potential mismatch between the user-inputted or selected weight and the actual connected weight of the adjustable kettlebell.

In the cradled position, the kettlebell safety mechanism includes a dial that is extended out of an indicator opening in an upper surface of a kettlebell handle. When the dial is extended out of the indicator opening, the dial may be freely rotated relative to the kettlebell handle. This may allow a change to the number of weights connected to the kettlebell handle, thereby changing the weight of the adjustable kettlebell.

In the embodiment shown, a selection mechanism extends through a handle bore in the kettlebell handle. The selection mechanism may include a selection shaft rotationally connected to a selection gear. The selection gear may be connected to one or more connector plates. The connector plates may be laterally movable (e.g., transverse or perpendicular to the longitudinal axis (e.g., the rotational axis of the selection gear and/or the selection shaft) as the selection gear rotates. The connector plates may include a connector tab. The connector plate may engage with a slot in a weight plate. When the kettlebell handle is placed in the uncradled position, the connector tab may engage with the slot in the weight plate, thereby connecting the weight plate to the kettlebell handle. As may be seen, the connected weight plate may lift any weight plates resting on top of the connected weight plate. Thus, to increase the weight of the adjustable kettlebell, the connector plate may be moved inward (e.g., toward the selection shaft) to engage the connector tab with a weight plate that supports more weight plates. To decrease the weight of the adjustable kettlebell, the connector plate may be moved outward to engage the connector tab 348 with a weight plate that supports fewer weight plates.

The selection shaft may be rotated by a drive shaft of a cradle. Selection shaft may be inserted into a keyed slot at an end of the drive shaft. The keyed slot may be complementarily shaped to the selection shaft such that, when the selection shaft is inserted into the keyed slot, the keyed slot may engage the selection shaft to rotate it. For example, the selection shaft may be hexagonally shaped, and the keyed slot may have a complementary hexagonal shape to receive the selection shaft.

In the embodiment shown, the selection gear includes a selection gear bore therethrough. The selection shaft may be inserted into the selection gear bore. The selection gear bore may have a complementary shape to the selection shaft. Thus, the selection shaft may be rotatably connected to the selection gear bore. Furthermore, the selection shaft may be longitudinally movable (e.g., movable along and/or parallel to the longitudinal axis) through the selection gear bore.

When the kettlebell handle is in the cradled position, the drive shaft and/or a sensor toggle in the drive shaft may push on the selection shaft. This may cause the selection shaft to move (e.g., slide or translate) in the longitudinal direction through the selection gear via the selection gear bore. This may push the dial out of the indicator opening, thereby allowing the selection gear to rotate and change which weight plate is connected to the connector plate. In this manner, the weight of the adjustable kettlebell may be changed when the adjustable kettlebell is in the cradled position.

In some embodiments, the kettlebell safety mechanism may include a resilient member. The resilient member may push against a stop-ring connected to the selection shaft. When the adjustable kettlebell is moved into the uncradled position, the resilient member may push on the selection gear to move the dial back into the retracted position. As discussed herein, this may cause a dial key to engage with an opening key, thereby preventing the dial, and therefore the entire selection mechanism, from rotating. This may prevent a change in the position of the connector plate, thereby preventing an inadvertent change in which weight plates are connected to the kettlebell handle. This may increase the safety of the adjustable kettlebell by reducing the chance of injury based on a falling or flying weight plate.

In some embodiments, an indicator opening opens into the upper surface of the kettlebell handle. The indicator opening includes a plurality of opening keys. A dial may be inserted into the indicator opening. The dial may include a dial key that protrudes or extends from the outer circumference of the dial. The dial key may be complementary to each opening key. In the retracted position of the dial, the dial key may be inserted into one of the opening keys. As may be seen, due to the interference between the dial key and the opening key, the dial may not be rotated. Because the dial is rotationally connected to the selection mechanism, this may prevent the selection mechanism from rotating, thereby preventing a change in weight to the adjustable kettlebell.

A cradle safety mechanism may include a position sensor. The position sensor may be toggled when an adjustable kettlebell is placed in the seat of the cradle. When the position sensor is toggled, a motor may be allowed to rotate a drive shaft. The drive shaft may be rotationally connected to a selector shaft of a selection mechanism. Rotating the drive shaft may cause the weight of the adjustable kettlebell to change. Thus, by toggling the position sensor, the motor may rotate the selection shaft to change the weight of the adjustable kettlebell.

In some embodiments, a weight adjustment system of the cradle may determine the connected weight of the adjustable kettlebell based on the rotational position of the drive shaft. Rotation of the drive shaft while the adjustable kettlebell is in the uncradled position may cause the weight adjustment system of the cradle to determine that the connected weight of the adjustable kettlebell is different than the actual connected weight. This may lead to user frustration and a decreased user experience based on the discrepancy in determined weight to the actual connected weight. To prevent unintended rotation of the drive shaft, when the adjustable kettlebell is in the uncradled position, the position sensor may prevent the motor from rotating the drive shaft. This may help to ensure that the determined weight of the adjustable kettlebell matches the actual weight of the adjustable kettlebell.

In some embodiments, the position sensor may be toggled using a sensor toggle longitudinally movable between a first sensor toggle position and a second sensor toggle position. The drive shaft may include a drive shaft bore extending therethrough. The sensor toggle may be a shaft that extends through the drive shaft bore. The sensor toggle may be longitudinally movable relative to the drive shaft. When the sensor toggle is pushed downward relative to the drive shaft into the first sensor toggle position, the position sensor may determine that the adjustable kettlebell is in the cradled position. When the sensor toggle is located upward relative to the drive shaft in the second sensor toggle position, position sensor may determine that the adjustable kettlebell is in the uncradled position.

The adjustable kettlebell may move the sensor toggle into the first sensor toggle position such that the position sensor determines that the adjustable kettlebell is in the cradled position. In some embodiments, when the adjustable kettlebell is placed in the cradled position, the selection shaft may press down on the sensor toggle to toggle the position sensor. When the adjustable kettlebell is removed from the cradle (e.g., when the adjustable kettlebell is moved into the uncradled position), a resilient member may urge the position sensor back into the second sensor toggle position.

In some embodiments, the position sensor may be connected to a control circuit. When the user provides an input to change the weight of the adjustable kettlebell, if the position sensor determines that the adjustable kettlebell is in the cradled position, the control circuit may provide instructions to the motor to rotate the drive shaft. If the position sensor determines that the adjustable kettlebell is in the uncradled position, the control circuit may provide instructions to the motor to not rotate the drive shaft.

In some embodiments, the position sensor may be part of a power circuit of the motor. In some embodiments, when the sensor toggle is depressed by the selection shaft (e.g., when the sensor toggle is in the first sensor toggle position), the sensor toggle may close the power circuit, thereby allowing the motor to rotate the drive shaft. When the sensor toggle is not depressed (e.g., when the sensor toggle is in the second sensor toggle position), the motor may not receive power, and the drive shaft may not be rotated.

In some embodiments, a method for locking an adjustable kettlebell may include placing an adjustable kettlebell in a cradle seat. When the adjustable kettlebell is placed in the cradle, a dial may be extended out of an indicator opening. When the dial is retracted in the indicator opening, a dial key may be recessed into an indicator key, thereby preventing the dial and a selection mechanism from rotating. When the dial and the dial key are extended out of the indicator opening and the opening key, a selection mechanism rotationally connected to the dial may be rotated to change a weight of the adjustable kettlebell.

The method may further include removing the adjustable kettlebell from the cradle. When the adjustable kettlebell is removed from the cradle, the dial may be retracted into the indicator opening such that the dial key is inserted back into an indicator key.

In some embodiments, a method for adjusting a weight of an adjustable kettlebell may include placing an adjustable kettlebell in a cradle. Placing the adjustable kettlebell in the cradle may move a sensor toggle from a second sensor toggle position to a first sensor toggle position. When the sensor toggle is moved to the first sensor toggle position, a position sensor may determine that the adjustable kettlebell is located in the cradle. A drive shaft may then be rotated to change a weight of the adjustable kettlebell.

The method may further include removing the adjustable kettlebell from the cradle. This may cause the sensor toggle to move from the first sensor toggle position to the second sensor toggle position. The position sensor may then determine that the adjustable kettlebell is not located in the cradle based on the sensor toggle being in the second sensor toggle position. The cradle may then receive an input to change the weight of the adjustable kettlebell. However, when the position sensor determines that the adjustable kettlebell is not in the cradle, the motor may be prevented from rotating the drive shaft.

Following are sections according to embodiments of the present disclosure:

A1. A cradle for a kettlebell, comprising:

a drive shaft rotatable by a motor, the drive shaft including a bore therethrough;

a sensor toggle extending through the bore, the sensor toggle being longitudinally movable in the bore between a first sensor toggle position and a second sensor toggle position;

a position sensor, wherein, when the sensor toggle is in the first sensor toggle position, the location sensor determines that the kettlebell is in a cradled position;

a motor connected to the drive shaft, wherein the motor rotates the drive shaft to change a weight of the kettlebell when location sensor determines that the kettlebell is in the cradled position.

A2. The cradle of section A1, further comprising a biasing element biasing the sensor toggle to the second sensor toggle position.

A3. The cradle of section A1 or A2, wherein, in the first sensor toggle position, the position sensor prevents the motor from rotating.

A4. The cradle of section A3, wherein the position sensor closes a power circuit to the motor in the second sensor toggle position, and wherein the power circuit to the motor is open in the first sensor toggle position.

A5. The cradle of any of sections A1-A4, further comprising an input device, and wherein, when a user provides an input to the input device and the location sensor indicates that the kettlebell is located on the cradle, the motor rotates the drive shaft.

A6. The cradle of any of sections A1-A5, wherein a selection shaft on the kettlebell moves the sensor toggle from the first sensor toggle position to the second sensor toggle position.

B1. An adjustable kettlebell, comprising:

a handle including a handle bore therethrough, the handle bore including an indicator opening in an upper surface of the handle, the indicator opening including a plurality of opening keys;

a selection mechanism including:

a selection shaft; and a dial extending into the indicator opening and rigidly connected to the selection shaft, the dial including a dial key, the dial key being complementary to each opening key of the plurality of opening keys, wherein the dial is longitudinally movable between an extended position and a retracted position by the selection shaft, wherein, in the retracted position, the dial key is inserted into an opening key of the plurality of opening keys.

B2. The kettlebell of section B1, wherein, in the extended position, the dial and the selection shaft are rotatable relative to the indicator opening the kettlebell of claim 7, wherein, in the retracted position, an interaction of the dial key with the opening key prevents the selection shaft from rotating.

B3. The kettlebell of section B1 or B2, wherein the selection mechanism further includes a resilient member urging the dial to the retracted position.

B4. The kettlebell of any of sections B1-B3, wherein the selection mechanism further includes:

a selection gear in the body bore, wherein the selection gear is rotatably connected to the selection shaft connector plates laterally movable by rotation of the selection gear, a lateral position of the connector plates determining a connected number of weight plates connected to the body.

B5. The kettlebell of section B4, wherein the selection shaft is longitudinally movable relative to the selection gear B6. The kettlebell of section B5, wherein the selection gear includes a selection gear bore therethrough and the selection shaft is inserted into the selection gear bore.

B7. The kettlebell of section B6, wherein the selection gear bore is complementary to the selection shaft.

C1. An adjustable kettlebell system, comprising:

a kettlebell including a kettlebell safety mechanism, the kettlebell safety mechanism including:

an indicator opening, the indicator opening including a plurality of opening keys; and a dial connected to a selection shaft, the dial including a dial key complementary to each opening key of the plurality of opening keys, when the kettlebell is in an uncradled position, the dial is inserted into the indicator opening such that the dial key is inserted into at an opening key of the plurality of opening keys;

a plurality of weight plates selectively connectable to the kettlebell;

a cradle, the cradle including:

a drive shaft, wherein, when the kettlebell is in a cradled position, the selection shaft is rotatably connected to the drive shaft;

a motor rotatably connected to the drive shaft;

a cradle safety mechanism, including:

a sensor toggle longitudinally movable in the drive shaft between a first sensor toggle position and a second sensor toggle position, wherein the sensor toggle is in the first sensor toggle position when the kettlebell is in the cradled position; and a position sensor toggled by the sensor toggle, wherein, when the position sensor is configured to rotate the drive shaft when the sensor toggle is in the first sensor toggle position.

C2. The system of section C1, wherein, when the kettlebell is in a cradled position, the dial is rotatable relative to the indicator opening.

C3. The system of section C1 or C2, wherein, in the cradled position, the selection shaft pushes on the sensor toggle to place the sensor toggle in the first sensor toggle position.

C4. The system of any of sections C1-C3, wherein, in the cradled position, the sensor toggle pushes on the selection shaft to move the dial out of the indicator opening.

C5. The system of any of section C1-C4, wherein, in the cradled position, the selection shaft pushes on the sensor toggle to place the sensor toggle in the first sensor toggle position and the sensor toggle pushes on the selection shaft to move the dial out of the indicator opening.

C6. The system of any of sections C1-C5, wherein a rotational position of the drive shaft determines a quantity of weight plates of the plurality of weight plates connected to the kettlebell C7. The system of any of sections C1-C6, further comprising a resilient member that pushes the dial into the indicator opening when the kettlebell is in the cradled position.

D1. A method for locking an adjustable kettlebell, comprising:

placing the adjustable kettlebell in a cradle;

extending a dial out of an indicator opening in a kettlebell handle, wherein, when the dial is retracted into the indicator opening, a dial key retracted into a complementary indicator opening prevent rotation of the dial; and rotating a selection mechanism to change a weight of the adjustable kettlebell, wherein the selection mechanism is rotationally connected to the dial.

D2. The method of section D2, further comprising:
removing the adjustable kettlebell from the cradle; and
retracting the dial into the indicator opening such that the dial key is inserted into the complementary indicator opening.

D3. The method of section D1, wherein the selection mechanism is rotated by a drive shaft of the cradle.

E1. A method for adjusting a weight of an adjustable kettlebell, comprising: placing the adjustable kettlebell in a cradle;
moving a sensor toggle from a second sensor toggle position to a first sensor toggle position;
determining that the adjustable kettlebell is located in the cradle; and
when the adjustable kettlebell is located in the cradle, rotating a drive shaft to change a weight of the adjustable kettlebell.

E2. The method of section E1, further comprising, before rotating the drive shaft, receiving an input to change the weight of the adjustable kettlebell.

E3. The method of section E1, further comprising:
removing the adjustable kettlebell from the cradle;
moving the sensor toggle from the first sensor toggle position to the second sensor toggle position; and
determining that the adjustable kettlebell is not located in the cradle.

E4. The method of section E3, further comprising:
receiving an input to change the weight of the adjustable kettlebell; and
when the adjustable is not located in the cradle, preventing the motor from rotating the drive shaft.

F1. A method having any or each permutation of features recited in sections D1 to E4.

G1. An assembly/system/device having any or each permutation of features recited in sections A1 to C7.

H1. Any system, assembly, component, subcomponent, process, element, or portion thereof, as described or illustrated.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

The articles "a," "an," and "the" are intended to mean that there are one or more of the elements in the preceding descriptions. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A method for locking an adjustable kettlebell, comprising:
placing the adjustable kettlebell in a cradle;
extending a dial out of an indicator opening in a handle of the kettlebell;
extending a dial key out of an opening key based at least in part on extending the dial out of the indicator opening; and
rotating a selection mechanism that is rotationally connected to the dial to change a weight of the adjustable kettlebell.

2. The method of claim 1, further comprising:
removing the adjustable kettlebell from the cradle; and
retracting the dial key into the opening key.

3. The method of claim 2, wherein, when the dial is retracted into the indicator opening, the dial key is retracted into the opening key and prevents rotation of the dial.

4. The method of claim 1, wherein rotating the selection mechanism comprises:

aligning the dial key with the opening key of a plurality of opening keys of the indicator opening.

5. The method of claim 1, wherein the selection mechanism is rotated by a drive shaft of the cradle.

6. The method of claim 1, wherein placing the adjustable kettlebell in the cradle causes the dial to extend out of the indicator opening.

7. The method of claim 1, wherein the cradle comprises a drive shaft, and wherein placing the adjustable kettlebell in the cradle comprises:

inserting the drive shaft into the adjustable kettlebell causing the dial to extend out of the indicator opening.

8. A method for adjusting a weight of an adjustable kettlebell, comprising:

placing the adjustable kettlebell in a cradle to extend a dial out of an indicator opening of the adjustable kettlebell;

extending a dial key out of an opening key based at least in part on extending the dial out of the indicator opening;

moving a sensor toggle from a second sensor toggle position to a first sensor toggle position;

determining that the adjustable kettlebell is located in the cradle; and rotating, based at least in part on determining that the adjustable kettlebell is located in the cradle, a drive shaft to change a weight of the adjustable kettlebell, wherein rotating the drive shaft comprises rotating a selection mechanism that is rotationally connected to the dial.

9. The method of claim 8, further comprising:

receiving, before rotating the drive shaft, an input to change the weight of the adjustable kettlebell.

10. The method of claim 8, further comprising:

removing the adjustable kettlebell from the cradle;

moving the sensor toggle from the first sensor toggle position to the second sensor toggle position; and determining that the adjustable kettlebell is not located in the cradle.

11. The method of claim 10, further comprising:

receiving an input to change the weight of the adjustable kettlebell; and preventing a motor in the cradle from rotating the drive shaft based at least in part on removing the adjustable kettlebell from the cradle.

12. The method of claim 8, wherein moving the sensor toggle from the second sensor toggle position to the first sensor toggle position triggers a position sensor.

13. A method for locking an adjustable kettlebell, the method comprising:

placing the adjustable kettlebell in a cradle, the cradle comprising a drive shaft and a sensor toggle, wherein placing the adjustable kettlebell in the cradle comprises inserting the drive shaft and the sensor toggle into the adjustable kettlebell;

depressing the sensor toggle to a depressed position with a weight of the adjustable kettlebell based at least in part on placing the adjustable kettlebell in the cradle;

pushing, with the drive shaft, a dial key in the adjustable kettlebell to an unlocked position out of an opening key based at least in part on placing the adjustable kettlebell in the cradle; and adjusting a weight of the adjustable kettlebell based at least in part on depressing the sensor toggle to the depressed position and pushing the dial key to the unlocked position.

14. The method of claim 13, wherein depressing the sensor toggle triggers a position sensor.

15. The method of claim 14, wherein the position sensor is connected to an input device on the cradle.

16. The method of claim 13, wherein the drive shaft is concentric with the sensor toggle.

17. The method of claim 13, further comprising:

removing the adjustable kettlebell from the cradle;

moving the sensor toggle to an undepressed position based at least in part on removing the adjustable kettlebell from the cradle;

moving the dial key to a locked position within the opening key; and locking adjustment of the adjustable kettlebell based at least in part on moving the sensor toggle to the undepressed position and on moving the dial key to the locked position.

18. The method of claim 17, further comprising:

receiving an input to adjust the weight of the adjustable kettlebell based at least in part on locking adjustment of the adjustable kettlebell; and preventing adjustment of the adjustable kettlebell based at least in part on receiving the input.

19. The method of claim 13, wherein pushing the dial key out of the opening key comprises:

pushing a dial out of an indicator opening.

* * * * *